US010845157B2

(12) United States Patent
Chavez

(10) Patent No.: US 10,845,157 B2
(45) **Date of Patent: *Nov. 24, 2020**

(54) FORWARD GRIP LASER (FGL)

(71) Applicant: BUSHNELL INC., Overland Park, KS (US)

(72) Inventor: Alejandro Chavez, Overland Park, KS (US)

(73) Assignee: BUSHNELL INC., Overland Park, KS (US)

( * ) Notice: Subject to any disclaimer, the term of this patent is extended or adjusted under 35 U.S.C. 154(b) by 22 days.

This patent is subject to a terminal disclaimer.

(21) Appl. No.: 16/249,013

(22) Filed: Jan. 16, 2019

(65) Prior Publication Data

US 2019/0145730 A1 May 16, 2019

Related U.S. Application Data

(63) Continuation of application No. 15/829,663, filed on Dec. 1, 2017, now Pat. No. 10,222,171.

(60) Provisional application No. 62/428,995, filed on Dec. 1, 2016.

(51) Int. Cl.

| | |
|---|---|
| ***F41C 23/16*** | (2006.01) |
| ***F41G 11/00*** | (2006.01) |
| ***F41G 1/35*** | (2006.01) |

(52) U.S. Cl.

CPC ..... *F41C 23/16* (2013.01); *F41G 1/35* (2013.01); *F41G 11/003* (2013.01)

(58) Field of Classification Search

CPC ..... F41C 23/16; F41G 1/35; F41G 11/003

See application file for complete search history.

(56) References Cited

U.S. PATENT DOCUMENTS

| | | | | |
|---|---|---|---|---|
| 5,661,279 | A * | 8/1997 | Kenmochi | H01H 13/702 200/305 |
| 8,683,733 | B2 * | 4/2014 | Gross | F41C 23/16 362/110 |
| 9,062,933 | B1 * | 6/2015 | Allen | F41G 1/35 |
| 9,182,194 | B2 * | 11/2015 | Moore | F41C 23/16 |
| 9,696,111 | B2 * | 7/2017 | Saadon | F41G 11/003 |
| 9,879,945 | B2 * | 1/2018 | Tuller, Jr. | F41G 1/00 |

(Continued)

OTHER PUBLICATIONS

Antwan17, "My Custom AR Pistol Overview", Feb. 26, 2013, https://www.youtube.com/watch?v=DTUbldYkmos (Year: 2013).*

*Primary Examiner* — Joshua T Semick

(74) *Attorney, Agent, or Firm* — Walter M. Egbert; Gerard M. Donovan; Reed Smith LLP

(57) ABSTRACT

A combination foregrip and laser sight device for use with a rifle or AR pistol. The device having a forward downwardly extending post with a horizontal surface, a rearward downwardly extending post with a horizontal surface, and a notch therebetween for receiving fingers of a left or right hand of a person. The foregrip body defining a first opening in the forward direction, a second opening in a starboard direction, and a third opening in a port direction. A laser housing of the device being disposed inside the first opening defined by the foregrip body. A starboard switch of the device being disposed in the second opening defined by the foregrip body. A port switch of the device being disposed in the third opening defined by the foregrip body. The switches being operatively coupled to the semiconductor chip for selective activation thereof.

21 Claims, 20 Drawing Sheets

(56) References Cited

U.S. PATENT DOCUMENTS

| | | | | |
|---|---|---|---|---|
| 10,024,629 | B2 * | 7/2018 | Sheets, Jr. | F41A 3/66 |
| 10,222,171 | B2 * | 3/2019 | Chavez | F41C 23/16 |
| 2011/0047850 | A1 * | 3/2011 | Rievley | F41C 23/16<br>42/72 |
| 2017/0082399 | A1 * | 3/2017 | Moore | F41G 1/36 |

* cited by examiner

FORWARD GRIP LASER (FGL)

CROSS-REFERENCE TO RELATED APPLICATION

This application is a continuation of U.S. application Ser. No. 15/829,663 filed on Dec. 1, 2017, which claims the benefit of U.S. Provisional Application No. 62/428,995 filed on Dec. 1, 2016, the disclosures of which are incorporated by reference herein.

BACKGROUND OF THE DISCLOSURE

Standardized mounting rails developed by the United States military have made it possible to mount a wide variety of accessories to a firearm. Weapon-mounted firearm accessories have become an important tool for military, police, militia, and civilian firearm users. Examples of popular firearm accessories include targeting devices, such as LASER sighting devices, and target illuminators, such as flashlights. Standardized mounting rails allow a single firearm to be reconfigured to meet certain mission specific needs. In this way, a firearm can be configured for mission specific needs. The primary limitation is the amount of available space on the mounting rails of a particular firearm. Accordingly, accessory arrangements that reduced the space required on mounting rails would be desirable. Additionally, any improvements with respect to ease of access to operational controls of accessories would be desirable.

Conventional long guns and handguns require sighting by raising the firearm to the eye and placing the firearm sight mechanism between the shooter's eye and the target. With long guns, the forestock has a hand receiving surface that is typically parallel to the gun axis. The forestock would typically lay in a diagonal line across the shooters palm transversing the hypothenar eminence and being supported by the Palmaris brevis palm muscle. This is ergonomically comfortable as the forward hand needs to support a substantial portion of the weight of the rifle where the butt of the rear stock is abutted against the shooter's shoulder.

So called "laser sights" allow aiming a firearm by positioning a laser "spot" on a target, the spot generated by a laser mounted on the firearm. Utilization of laser sights permit aiming and sighting the firearm without having to raise the firearm to eye level as is required with traditional gun mounted sights. Indeed, for long guns, or intermediate length weapons, keeping the gun level below the eye level and not abutting the shoulder rest offers allows flexibility in holding and firing the weapon. Moreover the weight of the long gun is more easily carried and can be held for a longer sustained amount of time in a position below shoulder height, for example at waist level or slightly higher.

The long guns known as modern sporting rifles ("MSR") that are semi-automatic and gas operated are extremely popular, particularly those known AR15's. Such MSRs often have Picatenny rails for mounting accessories at the forestocks, above, below, and on the sides of the forestocks. Recently it has become popular to remove or otherwise utilize the MSR without the rear stocks; these firearms have typically been called AR pistols. Such AR pistols do not have the rear stocks and butts to abut the shooters shoulder, thus using conventional optical sights positioned between the shooter's eye and the target will be more unsteady than a normal long rifle with a shoulder butt.

A laser sight specifically designed for a long gun and accommodating AR pistols would be welcome.

SUMMARY

MSR's and AR pistols are conveniently fired below shoulder level and often at waist level. In such a firing position, optical sights are not functional. A laser sight allows the shooter to aim and effectively sight the firearm without raising the firearm to eye level. The inventor has identified that a conventional foregrip used with the firearm at eye level is highly conducive to a forward hand palm/foregrip interface that is parallel to the barrel axis; but particularly for an MSR or an AR pistol, due to human anatomy, such a palm/foregrip parallel-to-the-barrel-axis interface is not ideal and is a bit awkward. Moreover, the weight of the firearm is more easily supported at levels below the conventional shoulder abutting level, particularly at waist level. These factors allow the foregrip to be readily supported by the fingers of the forward hand rather than the palm at the palmaris brevis palm muscle.

A combination foregrip and laser sight device for use with a firearm is particularly suitable for firing at a level below shoulder level, especially at waist level. The firearm may be a MSR with a forward picatinny rail below the barrel. The laser sight device including an angled finger grip that has finger engagement surfaces substantially linearly aligned along a line extending downward and rearward from the barrel axis and defining an angle of between 20 degrees and 50 degrees with respect to the device axis and barrel axis of the firearm to which it is mounted. In embodiments, a rail engagement portion extends the length of the forward post and innermost finger receiving surface In embodiments, the device has an upper rail engagement portion, a forward post portion with a laser housing and a laser light generator therein extending down from the rail engagement portion a distance of about a forefinger thickness, or about 0.6 to 0.9 inches. A recessed intermediate portion is rearward of the forward post, has a most recessed portion and a ramp portion. A rearward post is positioned rearward of the ramp portion. The recessed intermediate portion including a plurality of finger receiving portions each having a finger receiving surface. Each finger receiving portion and respective finger receiving surface extending lengthwise along the device about one finger width, or about 0.7 to 1.0 inches, measured lengthwise along the outer downward facing surface of the device. In embodiments, the forefinger receiving portion is the most inwardly recessed portion with second finger receiving portion being the second most inwardly recessed portion, a third finger (ring finger) receiving surface being the third most inwardly recessed surface, and a fourth finger receiving surface being the least inwardly recessed surface of the four finger receiving portions. In embodiments, the second and third finger receiving surfaces are on an inclined or ramp portion extending about two finger widths, or about 1.4 to 2.0 inches. In embodiments, a fourth finger receiving surface is positioned on the rearward post. The downward facing surface of the rearward post extending generally in a parallel direction to the axis of the device and the axis of a firearm upon the device is mounted. The length of downward surface of the rearward post being at least one finger width in length or 0.7 to 1.0 inches. In embodiments the first and fourth finger receiving surfaces are located on surfaces that extend parallel to the axis of the device and barrel of the firearm upon which the device is mounted. In embodiments, the second and third finger receiving surfaces are located on an inclined surface that generally has an angle of inclination in the range from 20 to 50 degrees.

In embodiments, on/off buttons are positioned laterally of the first finger receiving surface, thereby being accessible to both a forefinger on the finger receiving surface or a thumb of the same hand.

In embodiments the rearward post portion with a battery compartment and a battery therein, and an intermediate portion that extends between the rearward port portion and the forward post portion. A rail attachment portion extends substantially all or all of the forward rearward length of the device. A notch is defined by the forward post and the intermediate portion, the notch defined by an innermost surface parallel to the barrel axis, and two finger receiving surfaces on an angled portion of the intermediate portion.

The foregrip body defining a first opening in the forward direction, a second opening in a starboard direction, and a third opening in a port direction. A laser housing of the device being disposed inside the first opening defined by the foregrip body. The laser housing supporting a laser light generator configured as a semiconductor chip that emits laser light and a collimating lens that collimates the laser light emitted by the semiconductor chip. A starboard switch of the device being disposed in the second opening defined by the foregrip body. The second opening being positioned, for example, to receive a tip portion of a left index finger of the left hand while portions of the left hand is extending through the notch and the foregrip body is disposed between the left index finger and a left thumb of the left hand. The opening positioned rearwardly of the apex of the notch. A port switch of the device being disposed in the third opening defined by the foregrip body. The third opening being positioned to receive a tip portion of a right index finger of the right hand while a portion of the right hand is extending through the notch and the foregrip body is disposed between the right index finger and a right thumb of the right hand. The opening positioned above or rearwardly of the apex of the notch. The switches being operatively coupled to the semiconductor chip for selective activation thereof.

A feature and advantage of embodiments of the invention is a low profile foregrip with a forward post having a first horizontal downward facing surface, a rearward post having another horizontal downwardly facing surface, and a notch therebetween, the notch for receiving a user's hand with a pair of laser actuating buttons positioned above the notch on two sides of the foregrip. The notch defined by a rearward vertical surface on the vertical post, another horizontal downward facing surface directly rearward of the rearward facing surface, and an angled surface extending form the second horizontal surface. Each of the downwardly facing horizontal surfaces extending horizontally at least 0.5 cm. The forward and rearward horizontal surfaces providing a convenient stable seating surface for the barrel of the gun when using a gun rest for in the foregrip area.

A multi-function firearm accessory comprises a foregrip body supporting a laser housing for use with a firearm having a barrel. The foregrip body defines a notch for receiving a left or right hand of a person. The notch extends rearward from a rearward facing stop surface of the foregrip body to a finger engaging surface of the foregrip body. In one or more embodiments, the finger engaging surface is sloped so that the finger engaging surface extends downward as the finger engaging surface extends rearward. The foregrip body defines a first opening in the forward direction, a second opening in a starboard direction, and a third opening in a port direction. A laser housing disposed inside the first opening defined by the foregrip body. The laser housing supports a semiconductor chip that emits laser light and a collimating lens that collimates the laser light emitted by the semiconductor chip. A starboard switch is disposed in the second opening defined by the foregrip body. In one or more embodiments, the second opening is positioned to receive a tip portion of a left index finger of the left hand while a left palm of the left hand is extending through the notch and the foregrip body is disposed between the left index finger and a left thumb of the left hand. A port switch is disposed in the third opening defined by the foregrip body. In one or more embodiments, the third opening is positioned to receive a tip portion of a right index finger of the right hand while a right palm of the right hand is extending through the notch and the foregrip body is disposed between the right index finger and a right thumb of the right hand. The switches are operatively coupled to the semiconductor chip for selective activation thereof.

The multi-function firearm accessory comprises a foregrip body supporting a laser housing for use with a firearm. The firearm comprises a barrel having a breech end, a muzzle end, and a barrel wall. The barrel wall extends along a barrel axis in a forward direction from the breech end to the muzzle end and extending along the barrel axis in a rearward direction from the muzzle end to the breech end. The foregrip body defines a first opening in the forward direction, a second opening in a starboard direction, and a third opening in a port direction. A laser housing disposed inside the first opening defined by the foregrip body. The laser housing supports a semiconductor chip that emits laser light and a collimating lens that collimates the laser light emitted by the semiconductor chip. A starboard switch is disposed in the second opening defined by the foregrip body. In one or more embodiments, the second opening is positioned to receive a tip portion of a left index finger of the left hand while a left palm of the left hand is extending through the notch and the foregrip body is disposed between the left index finger and a left thumb of the left hand. A port switch is disposed in the third opening defined by the foregrip body. In one or more embodiments, the third opening is positioned to receive a tip portion of a right index finger of the right hand while a right palm of the right hand is extending through the notch and the foregrip body is disposed between the right index finger and a right thumb of the right hand. The switches are operatively coupled to the semiconductor chip for selective activation thereof.

The foregrip body defines a forward opening that opens in the forward direction, a starboard opening that opens in a starboard direction, and a port opening that opens in a port direction. In one or more embodiments, the starboard and port directions being orthogonal to a plane defined by the barrel axis and a vertical axis perpendicular to the barrel axis. A laser housing is disposed inside the forward opening defined by the foregrip body. The laser housing supports a semiconductor chip that emits laser light and a collimating lens that collimates the laser light emitted by the semiconductor chip. A forward end of the laser housing is coupled to a spherical bearing. In one or more embodiments, the spherical bearing constrains movement of the laser housing in three translation degrees of freedom corresponding to translation along three mutually orthogonal axes. In one or more embodiments, the three mutually orthogonal axes including a vertical axis, a horizontal axis and a longitudinal axis, the longitudinal axis being generally parallel to the barrel axis. In one or more embodiments, the spherical bearing allows rotation of the laser housing about at least the horizontal and vertical axes. In one or more embodiments, the spherical bearing comprises a spherical surface that is received in a cup.

A left to right or windage adjustment mechanism of the multi-function firearm accessory comprises a windage adjustment spring and a windage adjustment screw that is threadingly received in a windage adjustment insert. The windage adjustment insert includes a windage adjustment shoulder positioned and configured to limit travel of the windage adjustment screw. The windage adjustment spring is positioned and configured to bias the laser housing against the windage adjustment screw. The windage adjustment screw is positioned and configured so that rotation of the windage adjustment screw relative to the windage adjustment insert produces rotation of the laser housing about the vertical axis. An elevation adjustment mechanism of the multi-function firearm accessory comprises an elevation adjustment spring and an elevation adjustment screw that is threadingly received in an elevation adjustment insert. The elevation adjustment insert includes an elevation adjustment shoulder positioned and configured to limit travel of the elevation adjustment screw. The elevation adjustment spring is positioned and configured to bias the laser housing against the elevation adjustment screw. The elevation adjustment screw is positioned and configured so that rotation of the elevation adjustment screw relative to the elevation adjustment insert produces rotation of the laser housing about the horizontal axis. The left to right and elevation adjustments allow sighting in of the laser sight.

In one or more embodiments, the multi-function firearm accessory comprises a starboard switch and a port switch. In one or more embodiments, the starboard switch is disposed in the starboard opening defined by the foregrip body. The starboard switch comprises a starboard switch substrate overlaying a bottom surface of the starboard opening. The starboard switch spring overlays the starboard switch substrate and a starboard switch cap overlays the starboard switch spring. The starboard switch substrate comprises a first starboard conductor and a second starboard conductor disposed on a starboard facing surface of the starboard switch substrate. The starboard switch spring is deformable between an unstressed configuration in which an inner surface of the starboard switch spring is concave and a deformed configuration in which the starboard switch spring completes an electrical circuit between the first starboard conductor and the second starboard conductor of the starboard switch substrate. The starboard switch spring is positioned and configured to assume the deformed configuration when a portwardly directed depressing force is applied to the starboard switch cap.

In one or more embodiments, the foregrip body defines a notch for receiving a left or right hand of a person. The notch extends rearward from a rearward facing stop surface of the foregrip body to a finger engaging surface of the foregrip body. In one or more embodiments, the finger engaging surface is sloped so that the finger engaging surface extends downward as the finger engaging surface extends rearward. In one or more embodiments, the port switch is disposed in the port opening defined by the foregrip body. The port switch comprises a port switch substrate overlaying a bottom surface of the port opening. The port switch spring overlays the port switch substrate and a port switch cap overlays the port switch spring. The port switch substrate comprises a first port conductor and a second port conductor disposed on a portwardly facing surface of the port switch substrate. The port switch spring is deformable between an unstressed configuration in which an inner surface of the port switch spring is concave and a deformed configuration in which the port switch spring completes an electrical circuit between the first port conductor and the second port conductor of the port switch substrate. The port switch spring is positioned and configured to assume the deformed configuration when a starboardly directed depressing force is applied to the port switch cap.

A multi-function firearm accessory comprises a laser housing, a starboard switch and a port switch. The laser housing supports a semiconductor chip that emits laser light and a lens that collimates the laser light emitted by the semiconductor chip. The semiconductor chip is electrically connected to a printed wiring board by a first lead wire and a second lead wire. A battery is connected to the printed wiring board to provide power for the multi-function firearm accessory.

The starboard switch comprises a first conductor and a second conductor disposed on a starboard facing surface of a starboard switch substrate. The first conductor is electrically connected to the printed wiring board by a first switch wire. The second conductor is electrically connected to the printed wiring board by a second switch wire. The port switch comprises a first conductor and a second conductor disposed on a portward facing surface of a port switch substrate. The first conductor is electrically connected to the printed wiring board by a first switch wire. The second conductor is electrically connected to the printed wiring board by a second switch wire.

A multi-function firearm accessory in accordance with one or more embodiments may comprise a foregrip body defining a notch for receiving a left or right hand of a person. The foregrip body may support a laser housing for use with a firearm. The forward cavity may open in the forward direction and include a forward opening. The laser housing may support a semiconductor chip that emits laser light and a collimating lens that collimates the laser light emitted by the semiconductor chip. A forward end of the laser housing may be coupled to a spherical bearing, the spherical bearing constraining movement of the laser housing in three translation degrees of freedom corresponding to translation along three mutually orthogonal axes, the three mutually orthogonal axes including a vertical axis, a horizontal axis and a longitudinal axis, the longitudinal axis being generally parallel to a barrel axis of the firearm, the spherical bearing allowing rotation of the laser housing about at least the horizontal and vertical axes. The spherical bearing may comprise a spherical surface that is received in a cup.

The accessory may include a windage adjustment mechanism comprising a windage adjustment spring, a windage adjustment screw and a windage adjustment insert, the windage adjustment insert having a male thread and a female thread. The male thread of the windage adjustment insert being disposed in threaded engagement with a female thread of the foregrip body. The female thread of the windage adjustment insert being disposed in threaded engagement with a male thread of the windage adjustment screw. In some useful embodiments, an adhesive is applied between the male thread of the windage adjustment insert and the female thread of the foregrip body to reduce the likelihood that the parts will separate. The windage adjustment screw may define a windage O-ring groove and the windage O-ring may be partially received in the windage O-ring groove. The windage O-ring may be interposed between the windage adjustment screw and the windage adjustment insert. The windage adjustment insert may include a windage adjustment shoulder positioned and configured to limit travel of the windage adjustment screw. The windage adjustment spring may be positioned and configured to bias the laser housing against the windage adjustment screw and the windage adjustment screw may be positioned and configured so that rotation of the windage adjustment screw relative to the windage adjustment insert produces rotation of the laser housing about a vertical axis.

The accessory may include an elevation adjustment mechanism comprising an elevation adjustment spring, an elevation adjustment screw and an elevation adjustment insert, the elevation adjustment insert having a male thread and a female thread. The male thread of the elevation adjustment insert being disposed in threaded engagement with a female thread of the foregrip body. The female thread of the elevation adjustment insert being disposed in threaded engagement with a male thread of the elevation adjustment screw. In some useful embodiments, an adhesive is applied between the male thread of the elevation adjustment insert and the female thread of the foregrip body to reduce the likelihood that the parts will separate. The elevation adjustment screw may define an elevation O-ring groove and the elevation O-ring may be partially received in the elevation O-ring groove. The elevation O-ring may be interposed between the elevation adjustment screw and the elevation adjustment insert. The elevation adjustment insert may include an elevation adjustment shoulder positioned and configured to limit travel of the elevation adjustment screw. The elevation adjustment spring may be positioned and configured to bias the laser housing against the elevation adjustment screw and the elevation adjustment screw may be positioned and configured so that rotation of the elevation adjustment screw relative to the elevation adjustment insert produces rotation of the laser housing about a horizontal axis.

The accessory may include a starboard switch and a port switch. The starboard switch may be disposed in a starboard cavity opening defined by the foregrip body, the starboard cavity opening in the starboard direction and having a starboard opening. The starboard switch may comprise a starboard switch substrate overlaying a bottom surface of the starboard cavity. A starboard switch spring of the starboard switch may overlay the starboard switch substrate. A starboard switch cap of the starboard switch may overlay the starboard switch spring. A bead of sealant may form a fillet where the starboard switch cap meets a cylindrical surface of the foregrip body that defines the starboard cavity. The bead of sealant may form a water tight seal between the starboard switch cap and the cylindrical surface of the foregrip body that defines the starboard cavity. The bead of sealant may follow an arcuate path and form a circle. The port switch may be disposed in a port cavity defined by the foregrip body. The port switch may comprise a port switch substrate overlaying a bottom surface of the port cavity. A port switch spring of the port switch may overlay the port switch substrate. A port switch cap may overlay the port switch spring. The port cavity may open in a portward direction and include a port opening. A bead of sealant may form a fillet where the starboard switch cap meets a cylindrical surface of the foregrip body that defines the starboard cavity. The bead of sealant may form a water tight seal between the starboard switch cap and the cylindrical surface of the foregrip body that defines the starboard cavity. The bead of sealant may follow an arcuate path and form a circle. The firearm may comprise a barrel having a breech end, a muzzle end, and a barrel wall, the barrel wall extending along a barrel axis in a forward direction from the breech end to the muzzle end and extending along the barrel axis in a rearward direction from the muzzle end to the breech end.

A feature and advantage of one or more embodiments is a device accessory that replaces two firearm accessories (e.g., a laser sight and a fore stock).

A feature and advantage of one or more embodiments is a reduction in total weight of a firearm and accessories attached to the firearm.

A feature and advantage of one or more embodiments is a reduction in the length of mounting rail utilized to attach accessories to a firearm.

A feature and advantage of embodiments is a user friendly foregrip with a surface for receiving a user's palm angled about 20 to 45 degrees, the surface extending to a forward apex of a notch. In embodiments the actuation button for a laser is rearward of the forward notch apex and accommodates the user's finger pointing partially rearwardly when gripping the foregrip.

A feature and advantage of embodiments of the invention is a notch with an extended substantially forward-rearwardly extending surface in the notch sized for receiving two fingers.

A feature and advantage of embodiments of the invention is a low provide foregrip with a forward post having a first horizontal downward facing surface, a rearward post having a third horizontal downwardly facing surface, and a notch therebetween, the notch for receiving a user's hand with a pair of laser actuating buttons positioned above the notch on two sides of the foregrip. The notch defined by a rearward vertical surface on the vertical post, a second horizontal downward facing surface directly rearward of the rearward facing surface, and an angled surface extending form the second horizontal surface. Each of the downwardly facing horizontal surfaces extending at least 0.5 cm.

The above summary is not intended to describe each illustrated embodiment or every implementation of the present disclosure.

DESCRIPTION OF THE FIGURES

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
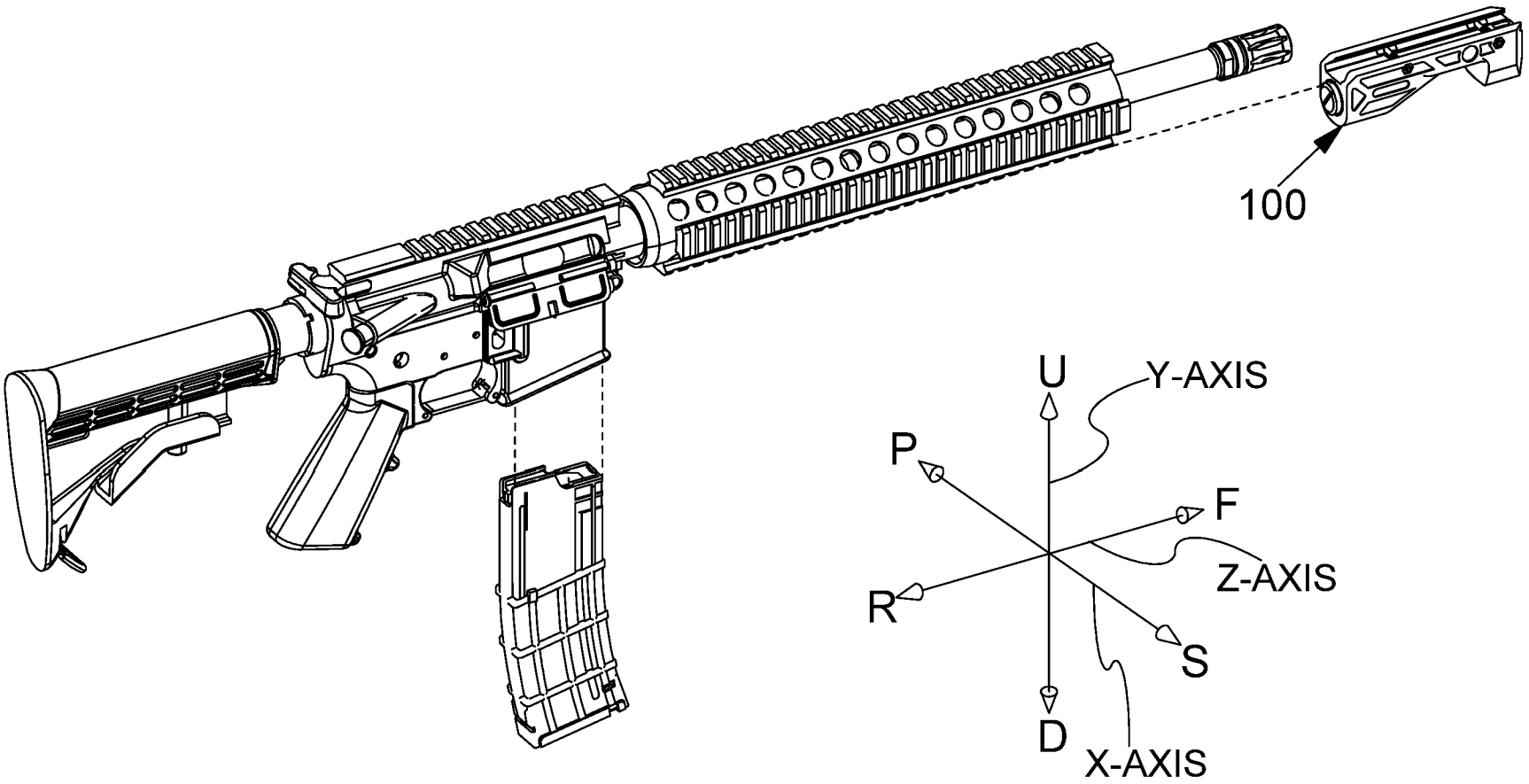
FIG. 1 is a partially exploded perspective view showing a firearm and a multi-function firearm accessory.

While embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Figure 14B:
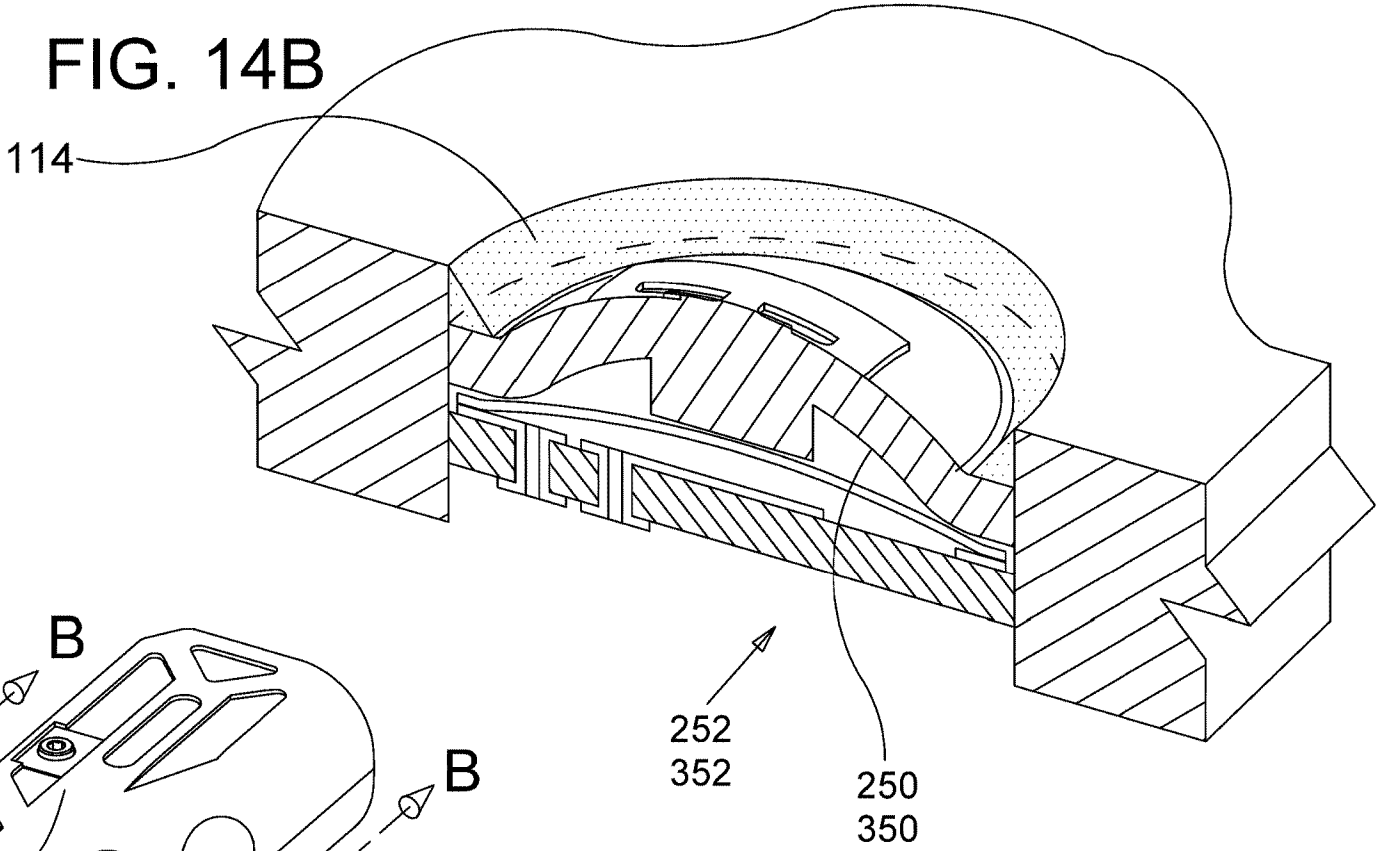
FIG. 14B is a perspective cross-sectional view taken along section line B-B shown in FIG. 14A.
Figure 14A:
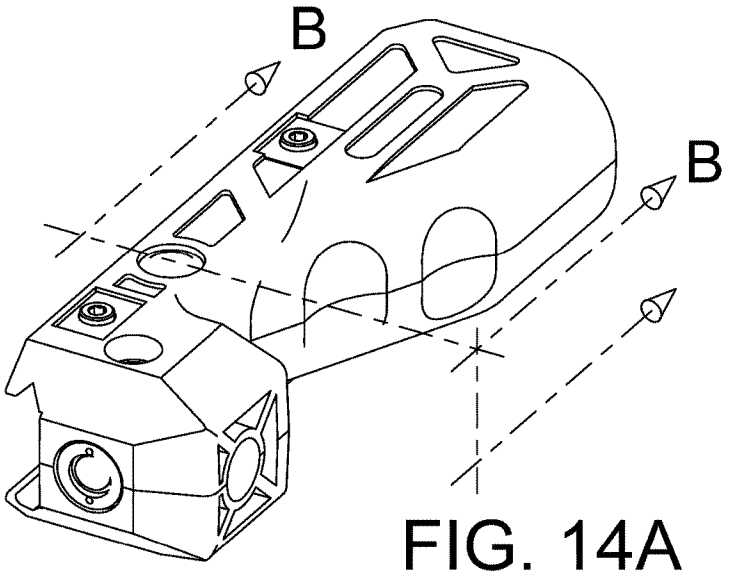
FIG. 14A is a perspective view showing a multi-function firearm accessory in accordance with the detailed description.
Figure 15:
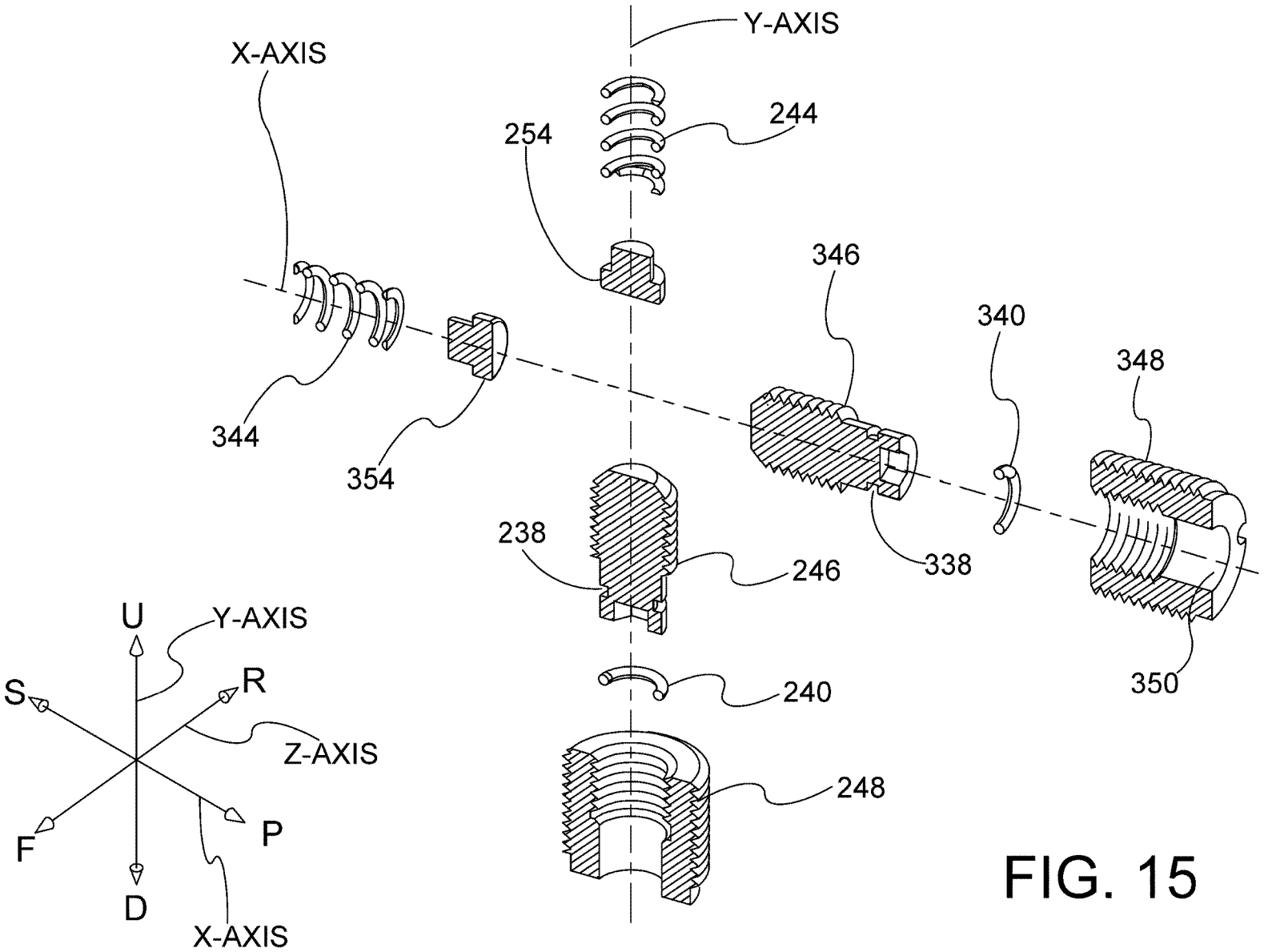
FIG. 15 is a perspective cross-sectional view further illustrating the elements shown in FIG. 7.
Figure 16B:
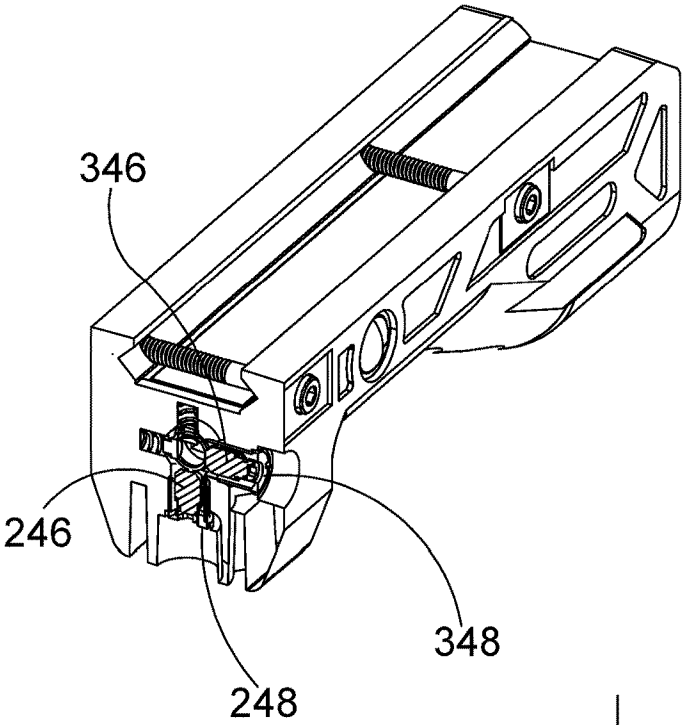
FIG. 16B is a perspective cross-sectional view taken along the section line shown in FIG. 16A.
Figure 16A:
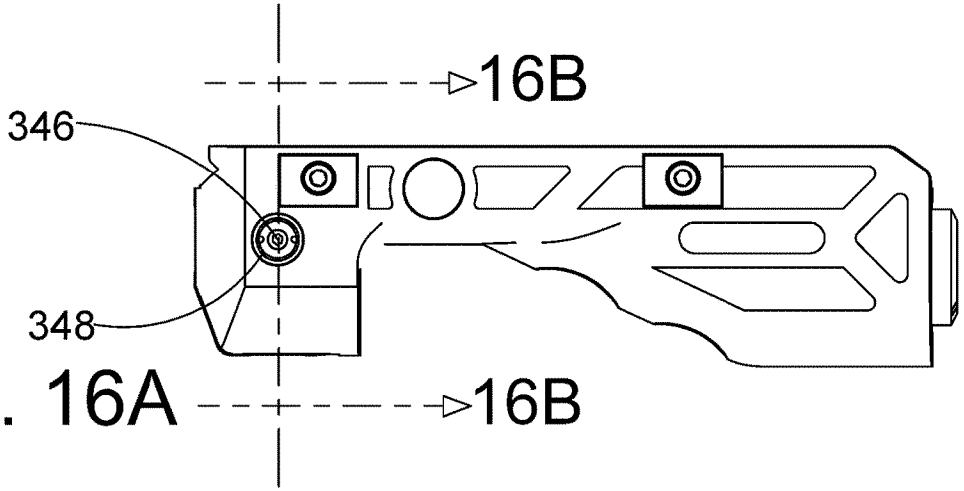
FIG. 16A is a side view showing a multi-function firearm accessory in accordance with the detailed description.
Figure 17:
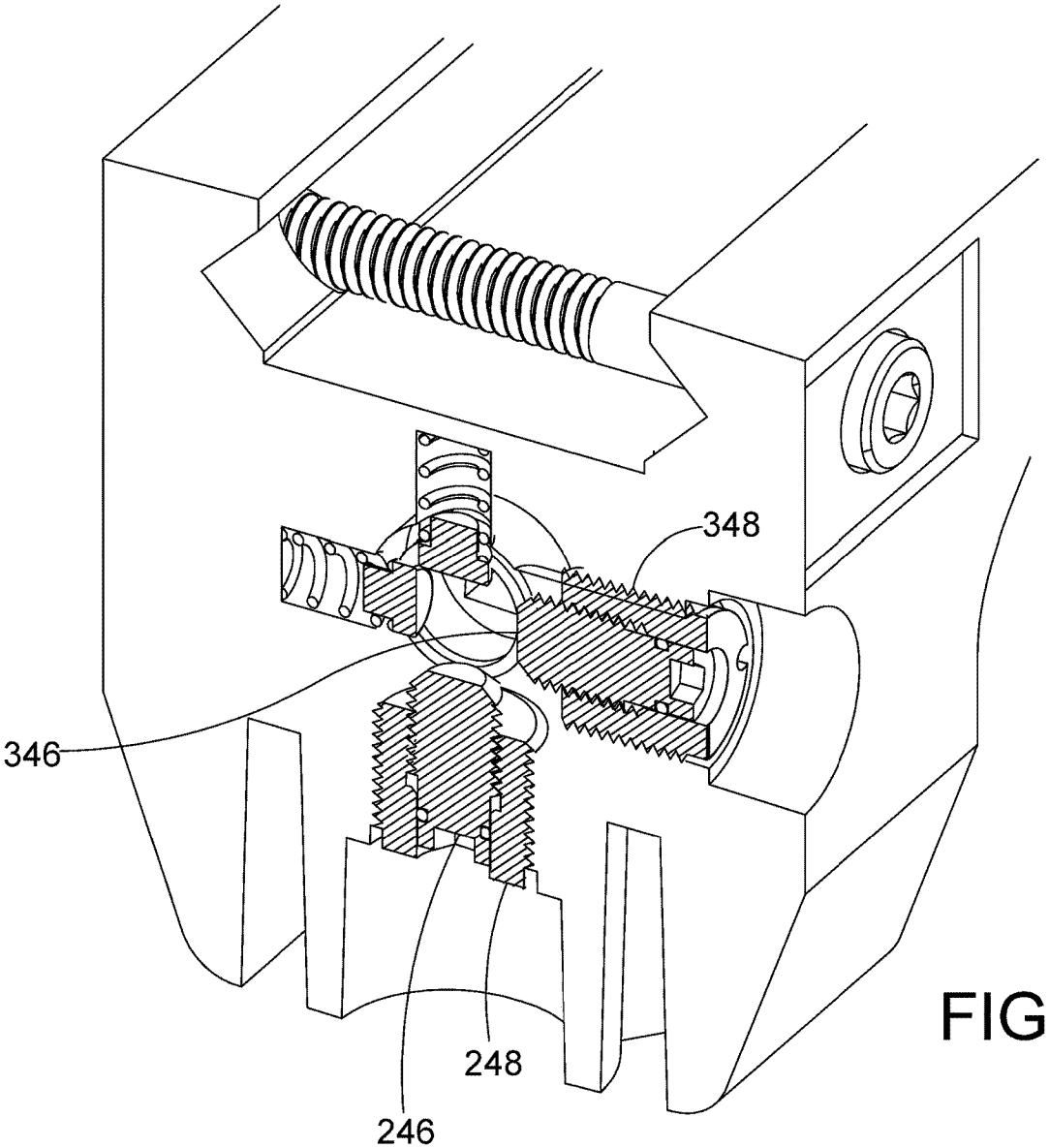
FIG. 17 is an enlarged perspective cross-sectional view corresponding to the perspective cross-sectional view shown in FIG. 16B.

Referring, for example, to FIGS. 14, 15 and 17, a device 100 in accordance with one or more embodiments has an upper rail engagement portion 90, a forward post portion 181 with a laser housing 124 and a laser light generator 126 therein extending down from the rail engagement portion 90 a distance of about a forefinger thickness, or about 0.6 to 0.9 inches. A recessed intermediate portion 58 is rearward of the forward post, has a most recessed portion 54 and a ramp portion 56. A rearward post portion 177 is positioned rearward of the ramp portion 56. The recessed intermediate portion 58 including a plurality of finger receiving portions each having a finger receiving surface. Each finger receiving portion and respective finger receiving surface extending lengthwise along the device about one finger width, or about 0.7 to 1.0 inches, measured lengthwise along the outer downward facing surface of the device. In embodiments, the forefinger receiving surface 52A is the most inwardly recessed portion with a second finger receiving surface 52B being the second most inwardly recessed portion, a third finger receiving portion 50C (configured to receive the ring finger) being the third most inwardly recessed surface, and a fourth finger receiving surface 52D being the least inwardly recessed surface of the four finger receiving portions. In embodiments, the fourth finger receiving portion 50D is configured to receive a pinky finger and the first finger receiving portion 50A is configured to receive a forefinger or index finger. In embodiments, the third finger receiving portion 50C is configured to receive a ring finger and the second finger receiving portion 50B is configured to receive a middle finger. The middle finger may be located between the index finger and the ring finger. In embodiments, the second and third finger receiving surfaces are on an inclined or ramp portion 56 extending about two finger widths, or about 1.4 to 2.0 inches. In embodiments, the fourth finger receiving surface 52D is positioned on the rearward post portion 177. The downward facing surface of the rearward post extending generally in a parallel direction to the axis of the device 100 and the axis of a firearm upon the device 100 is mounted. The length of downward surface of the rearward post portion 177 being at least one finger width in length or 0.7 to 1.0 inches. In embodiments the first and fourth finger receiving surfaces are located on surfaces that extend parallel to the axis of the device 100 and barrel of the firearm upon which the device 100 is mounted. In embodiments, the second and third finger receiving surfaces are located on an inclined surface 56 that generally has an angle of inclination in the range from 20 to 50 degrees. In embodiments, on/off buttons 252, 352 are positioned laterally of the first finger receiving surface 52A, thereby being accessible to both a forefinger on the first finger receiving surface 52A or a thumb of the same hand. In embodiments the body of the device includes a rearward post portion 177 with a battery compartment 26 and a battery 174 therein, a rearward post portion 181, and an intermediate portion that extends between the rearward post portion 177 and the forward post portion 181. A rail engagement portion 90 extends substantially all or all of the forward rearward length of the device 100. A notch 180 is defined by the forward post portion 181 and the recessed intermediate portion 58, the notch 180 being defined by an innermost surface parallel to the barrel axis, and two finger receiving surfaces on an angled portion 56 of the recessed intermediate portion 58.

Figure 2A:
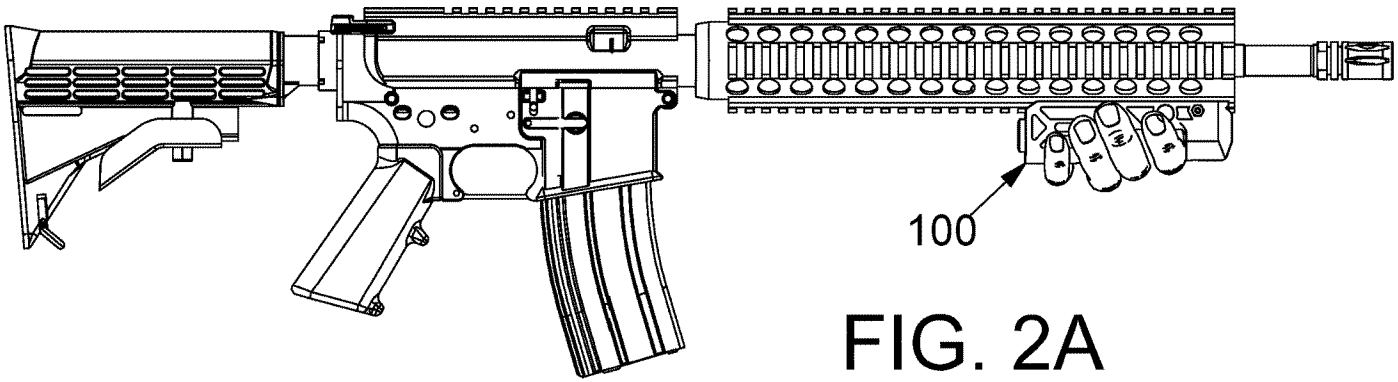
FIG. 2A is a side view showing a firearm with a multi-function firearm accessory attached.
Figure 2B:
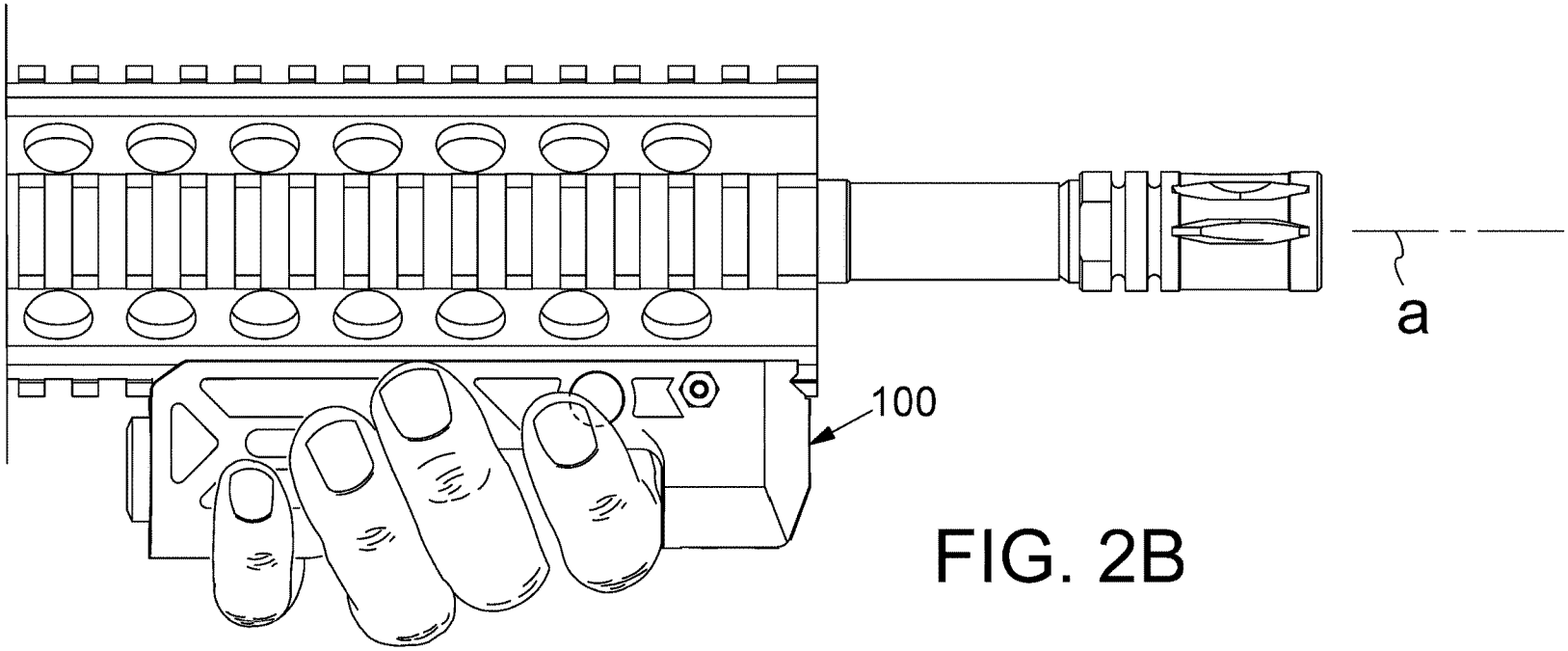
FIG. 2B is an enlarged side view further illustrating a portion of the firearm shown in FIG. 2A.
Figures 3A, 3B, 3C:
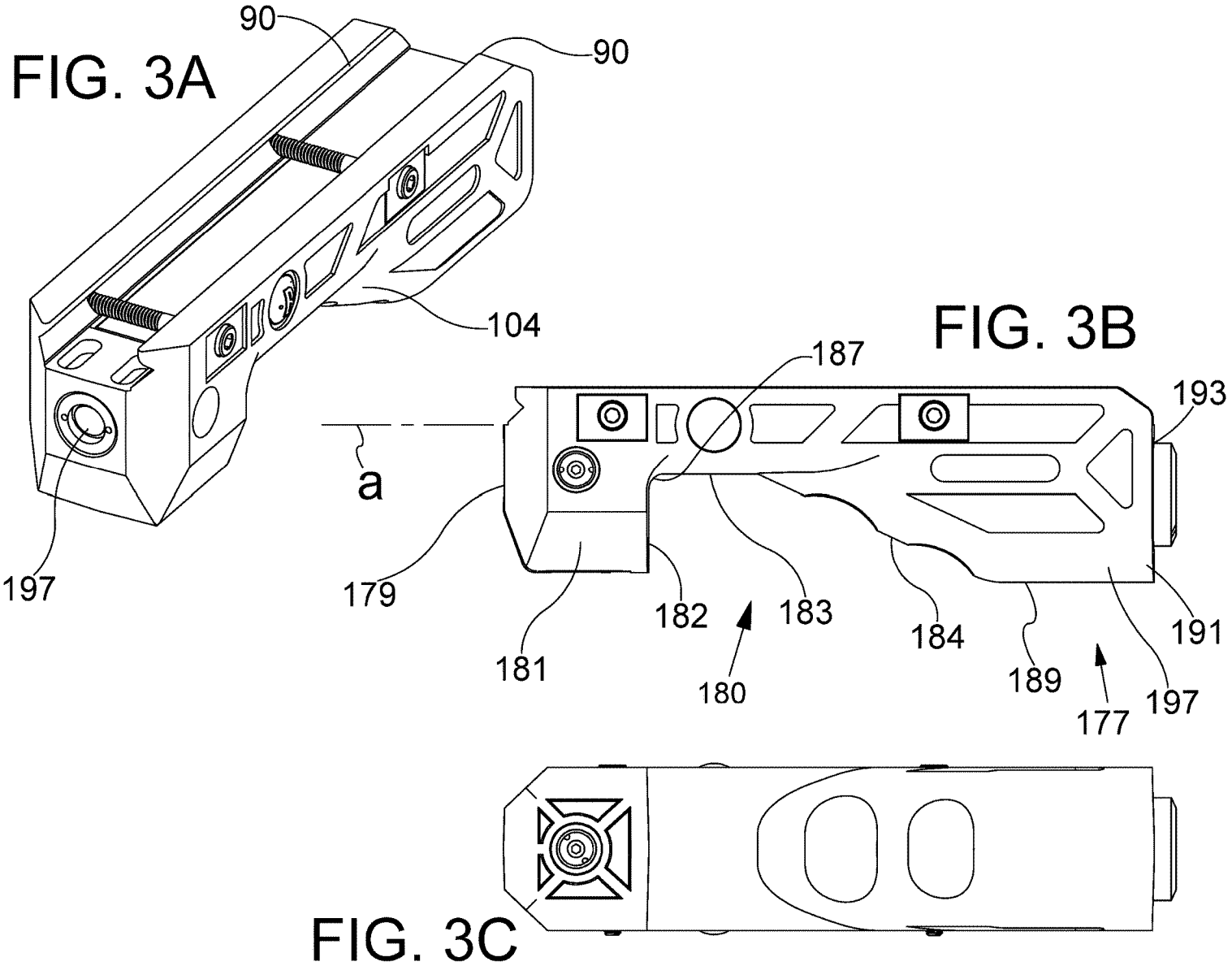
FIG. 3A is a perspective view showing a multi-function firearm accessory in accordance with the detailed description.
FIG. 3B is a side view of the accessory of FIG. 3A.
FIG. 3C is a bottom plan view of the accessory of FIG. 3A.
Figure 8:
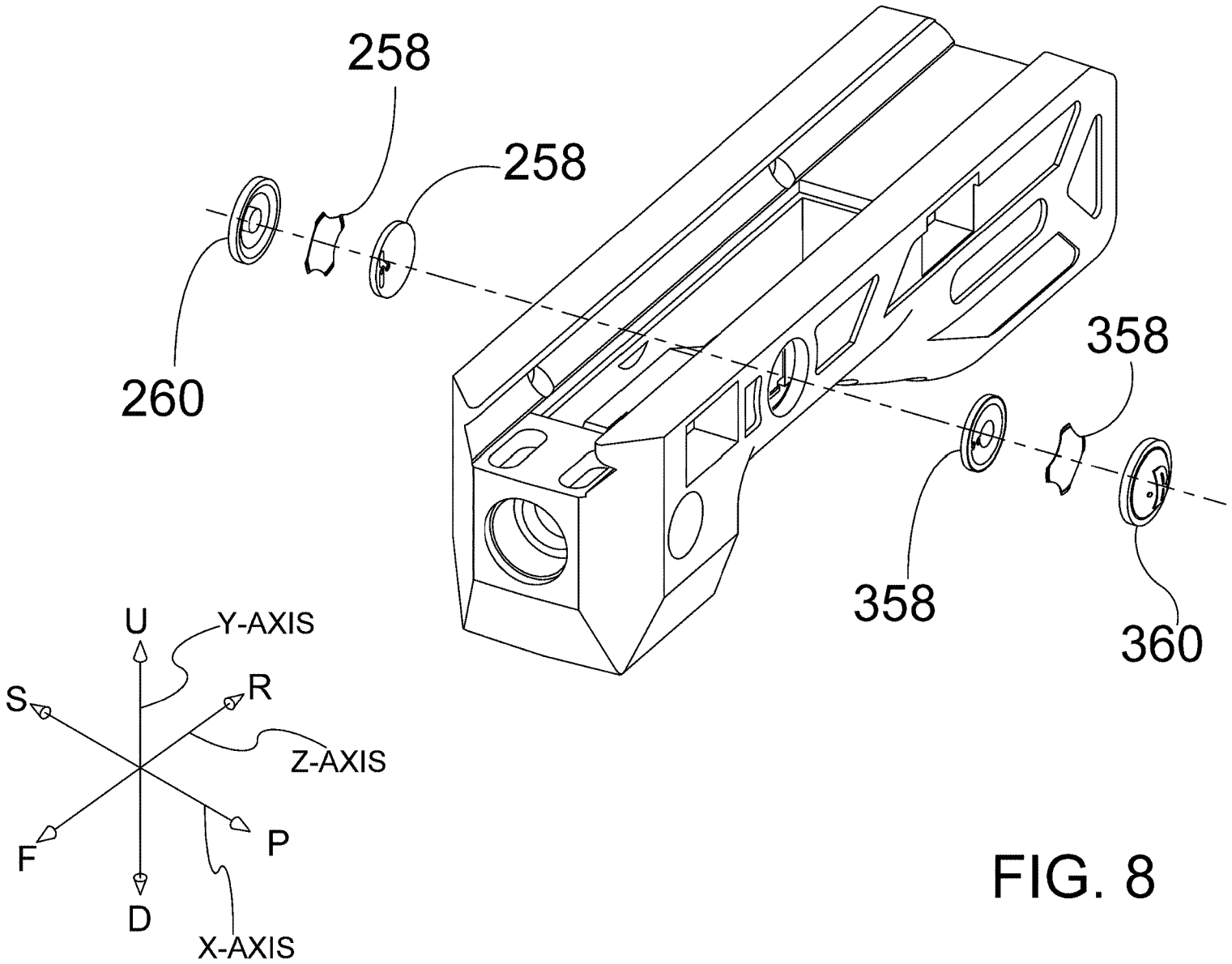
FIG. 8 is a partially exploded view showing a multi-function firearm accessory in accordance with the detailed description.
Figure 9B:
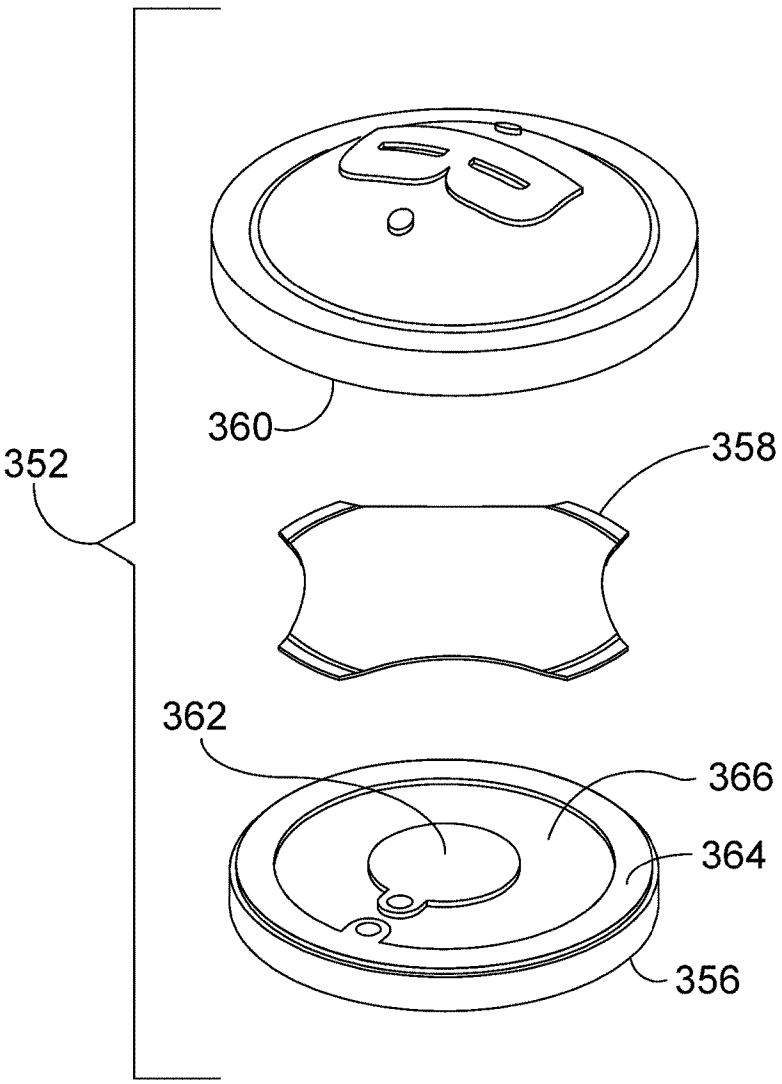
FIG. 9B is an enlarged exploded view further illustrating a switch in accordance with the detailed description.
Figure 9A:
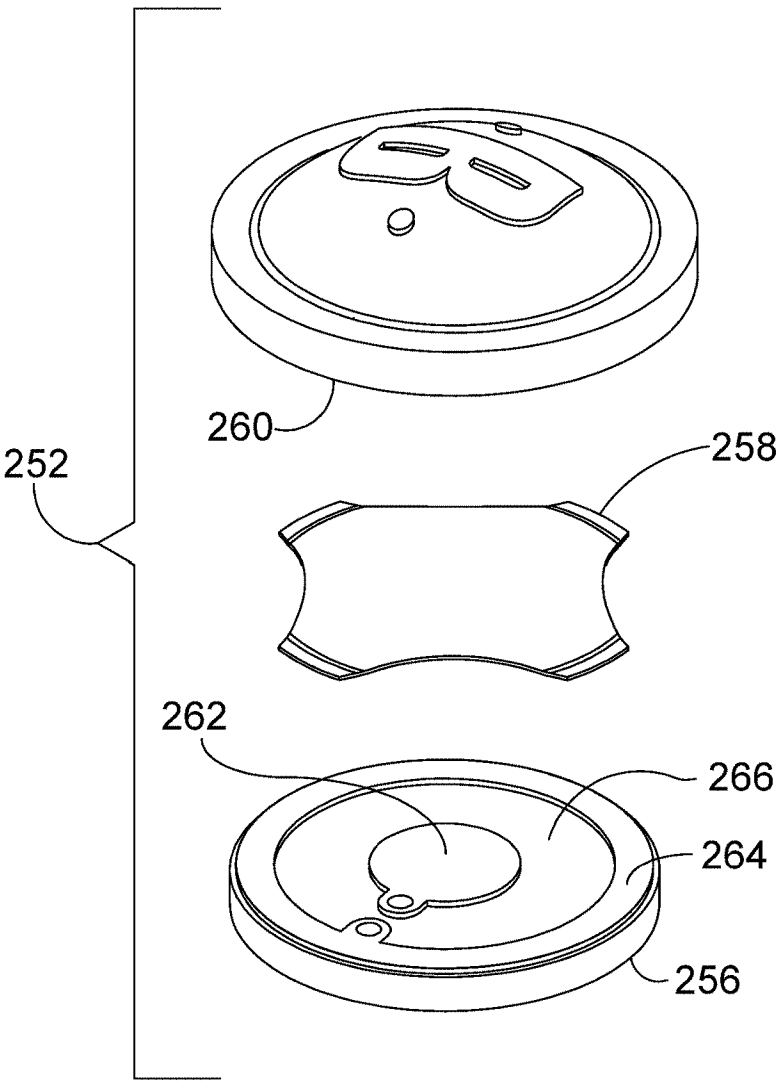
FIG. 9A is an enlarged exploded view further illustrating a switch in accordance with the detailed description.
Figure 10A:
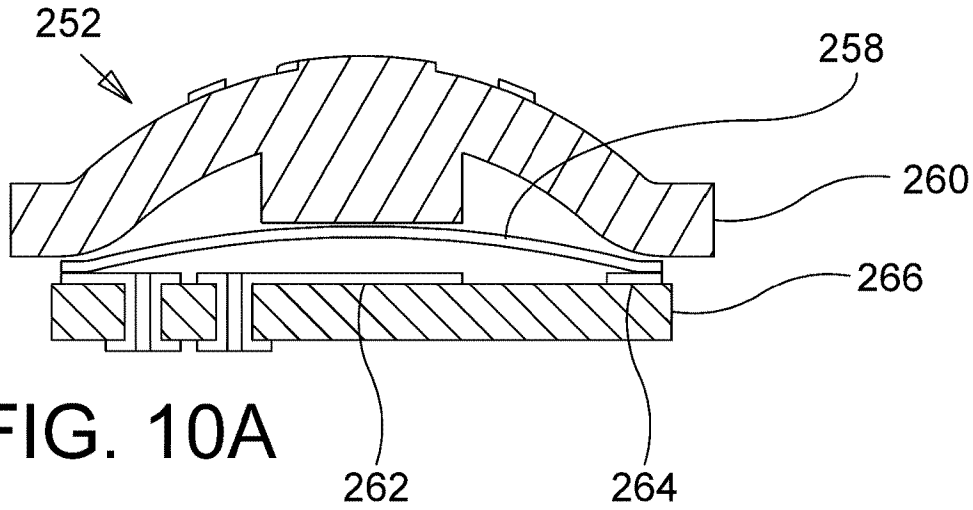
FIGS. 10A and 10B are enlarged cross-sectional views further illustrating a switch in accordance with the detailed description.
Figure 10B:
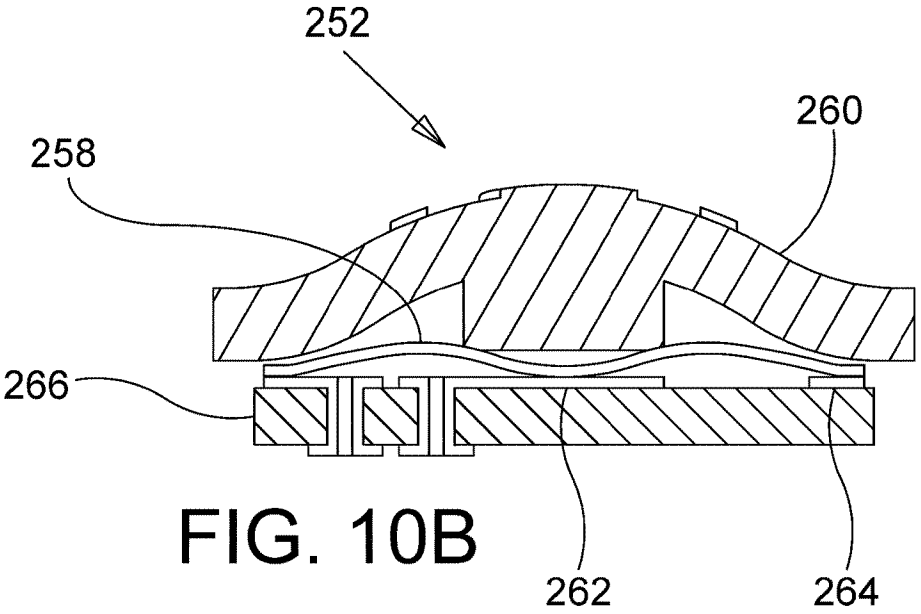

Referring, for example, to FIGS. 2, 3 and 8, a multi-function firearm accessory 100 comprises a foregrip body 104 supporting a laser housing 124 for use with a firearm having a barrel. The foregrip body 104 is ambidextrous and defines a notch 180 for receiving a left or right hand of a person. The notch 180 is defined rearward of a downwardly extending forward post 181 and forward of a rearward post 177. The forward post 181 has a forward facing vertical surface 179 normal to the axis a of the firearm, and a first downwardly facing forward-rearward extending horizontal non-angled surface extending parallel to the axis a of the firearm. The forward post 181 has a rearward facing vertical stop surface 182 that extends normally to the axis a of the firearm. In the notch, a second downwardly facing forward-rearward extending horizontal non-angled surface extending parallel to the axis a of the firearm provides a finger engaging surface 183 that is an inwardly most surface of the notch. This inwardly most surface extends from the stop surface at a forwardly most apex 187 rearwardly to an angled finger engaging surface 184 of the foregrip body 104. The angled surface is at an angle of about 25 degrees to 40 degrees from the axis a of the firearm and has two arcuate recesses when viewed from the side for receiving fingers. A third forward-rearward extending horizontal non angled surface 189 extending parallel to the axis a of the firearm extends rearwardly from angled surface 184 to an end 191 of the foregrip body. The end of the foregrip body 104 has a vertical surface 193 normal to the axis of the firearm. The laser generating element of the laser sight 197 is positioned at the forward facing vertical surface of the forward post 181.

The foregrip body 104 defines a forward cavity 110 having forward or first opening 112. The first opening in the forward direction, a second opening in a starboard direction, and a third opening in a port direction. A laser housing 124 disposed inside the first opening defined by the foregrip body 104. The laser housing 124 supports a semiconductor chip 126 that emits laser light and a collimating lens 128 that collimates the laser light emitted by the semiconductor chip 126. A starboard switch 252 is disposed in the second opening defined by the foregrip body. In one or more embodiments, the second opening is positioned to receive a tip portion of a left index finger of the left hand while a left palm of the left hand is extending through the notch and the foregrip body is disposed between the left index finger and a left thumb of the left hand. A port switch 352 is disposed in the third opening defined by the foregrip body. In one or more embodiments, the third opening is positioned to receive a tip portion of a right index finger of the right hand while a right palm of the right hand is extending through the notch and the foregrip body is disposed between the right index finger and a right thumb of the right hand. The switches are operatively coupled to the semiconductor chip for selective activation thereof.

Referring, for example, to FIGS. 4-10, a multi-function firearm accessory 100 comprises a foregrip body 104 supporting a laser housing 124 for use with a firearm. The firearm comprises a barrel having a breech end, a muzzle end, and a barrel wall. The barrel wall extends along a barrel axis in a forward direction from the breech end to the muzzle end and extending along the barrel axis in a rearward direction from the muzzle end to the breech end. The foregrip body 104 defines a first opening in the forward direction, a second opening in a starboard direction, and a third opening in a port direction. A laser housing 124 disposed inside the first opening defined by the foregrip body 104. The laser housing 124 supports a semiconductor chip 126 that emits laser light and a collimating lens 128 that collimates the laser light emitted by the semiconductor chip 126. A starboard switch 252 is disposed in the second opening defined by the foregrip body. In one or more embodiments, the second opening is positioned to receive a tip portion of a left index finger of the left hand while a left palm of the left hand is extending through the notch and the foregrip body is disposed between the left index finger and a left thumb of the left hand. A port switch 352 is disposed in the third opening defined by the foregrip body. In one or more embodiments, the third opening is positioned to receive a tip portion of a right index finger of the right hand while a right palm of the right hand is extending through the notch and the foregrip body is disposed between the right index finger and a right thumb of the right hand. The switches are operatively coupled to the semiconductor chip for selective activation thereof.

The foregrip body 104 defines a forward opening 108 that opens in the forward direction, a starboard opening 120 that opens in a starboard direction, and a port opening 122 that opens in a port direction. In one or more embodiments, the starboard and port directions are orthogonal to a plane defined by the barrel axis and a vertical axis perpendicular to the barrel axis. A laser housing 124 is disposed inside the forward opening 108 defined by the foregrip body 104. The laser housing 124 supports a semiconductor chip 126 that emits laser light and a collimating lens 128 that collimates the laser light emitted by the semiconductor chip 126. A forward end of the laser housing 124 is coupled to a spherical bearing 130. In one or more embodiments, the spherical bearing 130 constrains movement of the laser housing in three translation degrees of freedom corresponding to translation along three mutually orthogonal axes. In one or more embodiments, the three mutually orthogonal axes including a vertical axis, a horizontal axis and a longitudinal axis, the longitudinal axis being generally parallel to the barrel axis. In one or more embodiments, the spherical bearing allows rotation of the laser housing 124 about at least the horizontal and vertical axes. In one or more embodiments, the spherical bearing comprises a spherical surface that is received in a cup.

A windage adjustment mechanism 342 of the multi-function firearm accessory 100 comprises a windage adjustment spring 344 and a windage adjustment screw 346 that is threadingly received in a windage adjustment insert 348. The windage adjustment insert 348 includes a windage adjustment shoulder 350 positioned and configured to limit travel of the windage adjustment screw 346. The windage adjustment spring 344 is positioned and configured to bias the laser housing 124 against the windage adjustment screw 346. The windage adjustment screw 346 is positioned and configured so that rotation of the windage adjustment screw 346 relative to the windage adjustment insert 348 produces rotation of the laser housing 124 about the vertical axis. An elevation adjustment mechanism 242 of the multi-function firearm accessory 100 comprises an elevation adjustment spring 244 and an elevation adjustment screw 246 that is threadingly received in an elevation adjustment insert 248. The elevation adjustment insert 248 includes an elevation adjustment shoulder 250 positioned and configured to limit travel of the elevation adjustment screw 246. The elevation adjustment spring 244 is positioned and configured to bias the laser housing 124 against the elevation adjustment screw 246. The elevation adjustment screw 246 is positioned and configured so that rotation of the elevation adjustment screw 246 relative to the elevation adjustment insert 248 produces rotation of the laser housing 124 about the horizontal axis.

In one or more embodiments, the multi-function firearm accessory 100 comprises a starboard switch 252 and a port switch 352. In one or more embodiments, the starboard switch 252 is disposed in the starboard opening 120 defined by the foregrip body 104. The starboard switch 252 comprises a starboard switch substrate 256 overlaying a bottom surface of the starboard opening 120. The starboard switch spring 258 overlays the starboard switch substrate 256 and a starboard switch cap 260 overlays the starboard switch spring 258. The starboard switch substrate 256 comprises a first starboard conductor 262 and a second starboard conductor 264 disposed on a starboard facing surface 266 of the starboard switch substrate. The starboard switch spring 258 is deformable between an unstressed configuration in which an inner surface of the starboard switch spring 258 is concave and a deformed configuration in which the starboard switch spring 258 completes an electrical circuit between the first starboard conductor 262 and the second starboard conductor 264 of the starboard switch substrate 256. The starboard switch spring 258 is positioned and configured to assume the deformed configuration when a portwardly directed depressing force is applied to the starboard switch cap 260.

In one or more embodiments, the foregrip body 104 defines a notch 180 for receiving a left or right hand of a person. The notch 180 extends rearward from a rearward facing stop surface 182 of the foregrip body 104 to a finger engaging surface 184 of the foregrip body 104. In one or more embodiments, the finger engaging surface 184 is sloped so that the finger engaging surface 184 extends downward as the finger engaging surface 184 extends rearward. In one or more embodiments, the port switch 352 is disposed in the port opening 122 defined by the foregrip body 104. The port switch 352 comprises a port switch substrate 356 overlaying a bottom surface of the port opening 122. The port switch spring 358 overlays the port switch substrate 356 and a port switch cap 360 overlays the port switch spring 358. The port switch substrate 356 comprises a first port conductor 362 and a second port conductor 364 disposed on a portward facing surface 366 of the port switch substrate 356. The port switch spring 358 is deformable between an unstressed configuration in which an inner surface of the port switch spring 358 is concave and a deformed configuration in which the port switch spring 358 completes an electrical circuit between the first port conductor 362 and the second port conductor 364 of the port switch substrate 356. The port switch spring 358 is positioned and configured to assume the deformed configuration when a starboardly directed depressing force is applied to the port switch cap 360.

Figure 11:
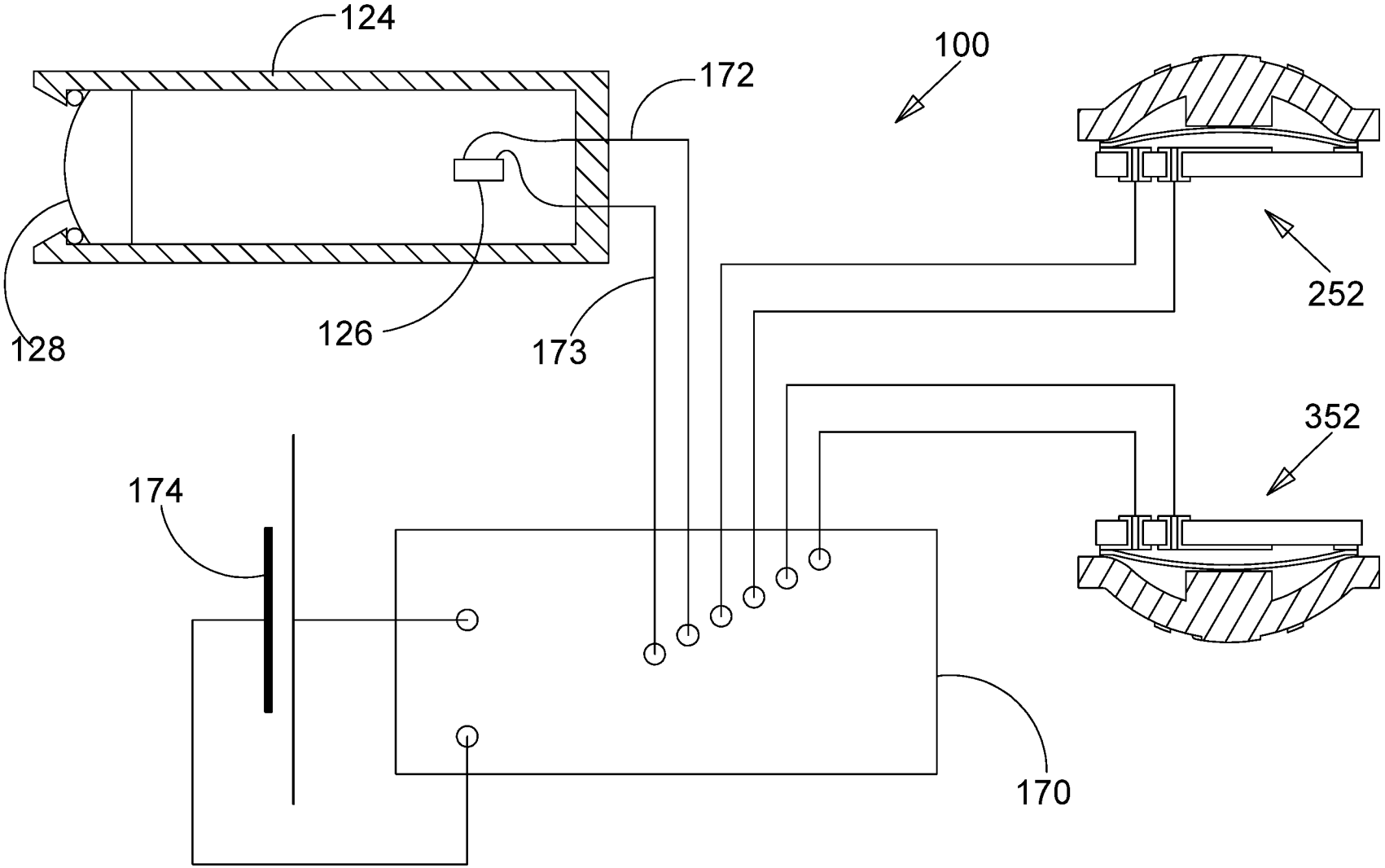
FIG. 11 is a diagram further illustrating the structure of a multi-function firearm accessory in accordance with the detailed description.

Referring to FIG. 11, a multi-function firearm accessory 100 comprises a laser housing 124, a starboard switch 252 and a port switch 352. The laser housing 124 supports a semiconductor chip 126 that emits laser light and a lens 128 that collimates the laser light emitted by the semiconductor chip 126. The semiconductor chip 126 is electrically connected to a printed wiring board 170 by a first lead wire 172 and a second lead wire 173. A battery 174 is connected to the printed wiring board 170 to provide power for the multi-function firearm accessory 100.

The starboard switch 252 comprises a first starboard conductor 262 and a second starboard conductor 264 disposed on a starboard facing surface 266 of a starboard switch substrate 256. The first starboard conductor 262 is electrically connected to the printed wiring board by a first switch wire. The second starboard conductor 264 is electrically connected to the printed wiring board by a second switch wire. The port switch 352 comprises a first port conductor 362 and a second port conductor 364 disposed on a portward facing surface 366 of a port switch substrate 356. The first port conductor 362 is electrically connected to the printed wiring board by a first switch wire. The second port conductor 364 is electrically connected to the printed wiring board by a second switch wire.

Figure 12B:
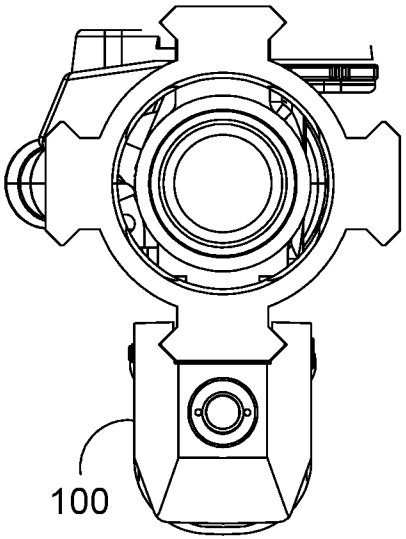
FIG. 12B is a front view showing a multi-function firearm accessory detachably attached to a mounting rail of a firearm.
Figure 12A:
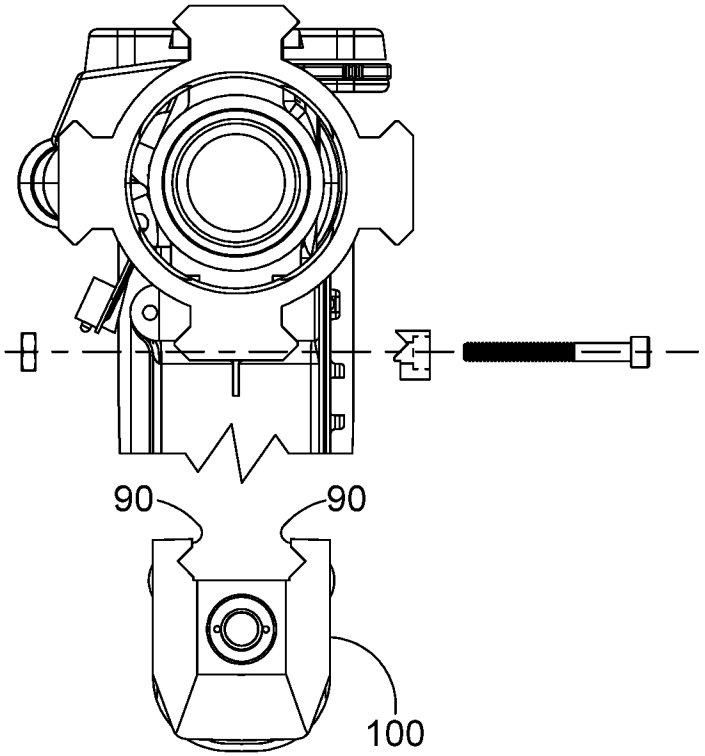
FIG. 12A is a partially exploded front view showing a multi-function firearm accessory configured to be detachably attached to a mounting rail of a firearm.
Figure 13:
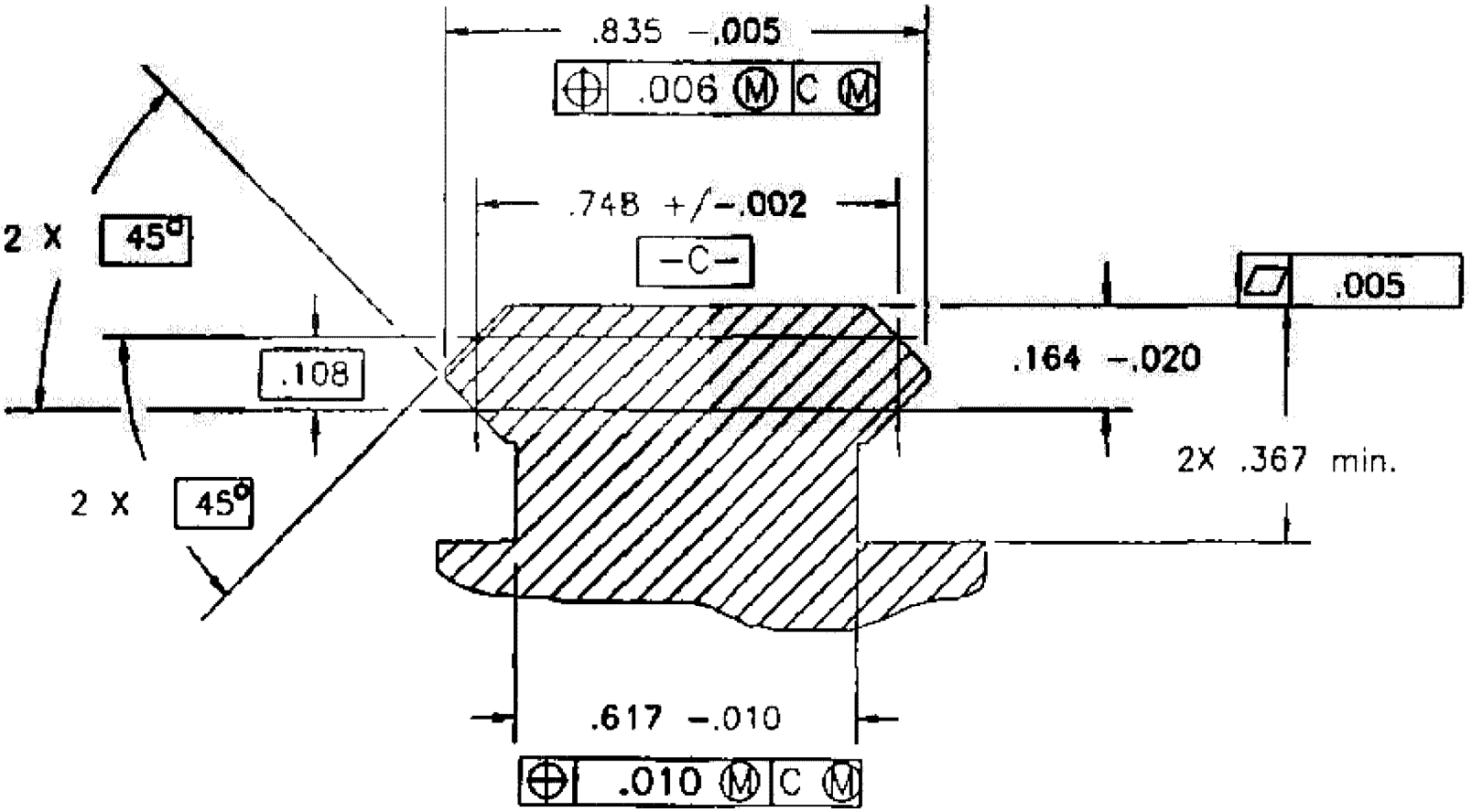
FIG. 13 PRIOR ART
FIG. 13 is a reproduction of a mounting rail drawing from Military Standard MIL-STD-1913 dated 3 Feb. 1995.

FIG. 12A is a partially exploded front view showing a multi-function firearm accessory 100 configured to be detachably attached to a mounting rail of a firearm. The foregrip body 104 of the multi-function firearm accessory 100 includes a mounting portion that is dimensioned and configured to mate with a mounting rail, such as, for example, a Picatinny rail and/or a Weaver rail. FIG. 13 is a reproduction of a mounting rail drawing from Military Standard MIL-STD-1913 dated 3 Feb. 1995. The multi-function firearm accessory 100 also includes a clamp member, a nut and a screw. A mounting rail may clamped between the camp member and the mounting portion of the foregrip body 104 by tightening the screw. FIG. 12B is a front view showing a multi-function firearm accessory 100 detachably attached to a mounting rail of a firearm.

Referring, for example, to FIGS. 14, 15 and 17, a multi-function firearm accessory in accordance with one or more embodiments may comprise a foregrip body 104 defining a notch 180 for receiving a left or right hand of a person. The foregrip body 104 may support a laser housing 124 for use with a firearm. The forward cavity 112 may open in the forward direction and include a forward opening 110. The laser housing 124 may support a semiconductor chip 126 that emits laser light and a collimating lens 128 that collimates the laser light emitted by the semiconductor chip 126. A forward end of the laser housing 124 may be coupled to a spherical bearing, the spherical bearing 130 constraining movement of the laser housing 124 in three translation degrees of freedom corresponding to translation along three mutually orthogonal axes, the three mutually orthogonal axes including a vertical axis, a horizontal axis and a longitudinal axis, the longitudinal axis being generally parallel to a barrel axis of the firearm, the spherical bearing 130 allowing rotation of the laser housing 124 about at least the horizontal and vertical axes. The spherical bearing 130 may comprise a spherical surface that is received in a cup.

The accessory 100 may include a windage adjustment mechanism 342 comprising a windage adjustment spring 344, a windage adjustment screw 346 and a windage adjustment insert 348, the windage adjustment insert 348 having a male thread and a female thread. The male thread of the windage adjustment insert 348 being disposed in threaded engagement with a female thread of the foregrip body 104. The female thread of the windage adjustment insert 348 being disposed in threaded engagement with a male thread of the windage adjustment screw 346. In some useful embodiments, an adhesive is applied between the male thread of the windage adjustment insert 348 and the female thread of the foregrip body 104 to reduce the likelihood that the parts will separate. The windage adjustment screw 346 may define a windage O-ring groove 338 and the windage O-ring 340 may be partially received in the windage O-ring groove 338. The windage O-ring 340 may be interposed between the windage adjustment screw 346 and the windage adjustment insert 348. The windage adjustment insert 348 may include a windage adjustment shoulder 350 positioned and configured to limit travel of the windage adjustment screw 346. The windage adjustment spring 344 may be positioned and configured to bias the laser housing 124 against the windage adjustment screw 346 and the windage adjustment screw 346 may be positioned and configured so that rotation of the windage adjustment screw 346 relative to the windage adjustment insert 348 produces rotation of the laser housing 124 about a vertical axis.

The accessory 100 may include an elevation adjustment mechanism 242 comprising an elevation adjustment spring 244, an elevation adjustment screw 246 and an elevation adjustment insert 248, the elevation adjustment insert 248 having a male thread and a female thread. The male thread of the elevation adjustment insert 248 being disposed in threaded engagement with a female thread of the foregrip body 104. The female thread of the elevation adjustment insert 248 being disposed in threaded engagement with a male thread of the elevation adjustment screw 246. In some useful embodiments, an adhesive is applied between the male thread of the elevation adjustment insert 248 and the female thread of the foregrip body 104 to reduce the likelihood that the parts will separate. The elevation adjustment screw 246 may define an elevation O-ring groove 238 and the elevation O-ring 240 may be partially received in the elevation O-ring groove 238. The elevation O-ring 240 may be interposed between the elevation adjustment screw 246 and the elevation adjustment insert 248. The elevation adjustment insert 248 may include an elevation adjustment shoulder 250 positioned and configured to limit travel of the elevation adjustment screw 246. The elevation adjustment spring 244 may be positioned and configured to bias the laser housing 124 against the elevation adjustment screw 246 and the elevation adjustment screw 246 may be positioned and configured so that rotation of the elevation adjustment screw 246 relative to the elevation adjustment insert 248 produces rotation of the laser housing 124 about a horizontal axis.

The accessory 100 may include a starboard switch and a port switch 352. The starboard switch may be disposed in a starboard cavity 120 opening defined by the foregrip body, the starboard cavity 120 opening in the starboard direction and having a starboard opening 118. The starboard switch 252 may comprise a starboard switch substrate 256 overlaying a bottom surface of the starboard cavity 120. A starboard switch spring 258 of the starboard switch 252 may overlay the starboard switch substrate 256. A starboard switch cap 260 of the starboard switch 252 may overlay the starboard switch spring 258. A bead of sealant 114 may form a fillet where the starboard switch cap 260 meets a cylindrical surface of the foregrip body 104 that defines the starboard cavity 120. The bead of sealant 114 may form a water tight seal between the starboard switch cap 260 and the cylindrical surface of the foregrip body 104 that defines the starboard cavity 120. The bead of sealant 114 may follow an arcuate path and form a circle. The port switch 352 may be disposed in a port cavity 122 defined by the foregrip body 104. The port switch 352 may comprise a port switch substrate 356 overlaying a bottom surface of the port cavity 122. A port switch spring 358 of the port switch may overlay the port switch substrate 356. A port switch cap 360 may overlay the port switch spring 358. The port cavity 122 may open in a portward direction and include a port opening 116. A bead of sealant 114 may form a fillet where the starboard switch cap 260 meets a cylindrical surface of the foregrip body 104 that defines the starboard cavity 120. The bead of sealant 114 may form a water tight seal between the starboard switch cap 260 and the cylindrical surface of the foregrip body 104 that defines the starboard cavity 120. The bead of sealant 114 may follow an arcuate path and form a circle. The firearm may comprise a barrel having a breech end, a muzzle end, and a barrel wall, the barrel wall extending along a barrel axis in a forward direction from the breech end to the muzzle end and extending along the barrel axis in a rearward direction from the muzzle end to the breech end.

Figure 4:
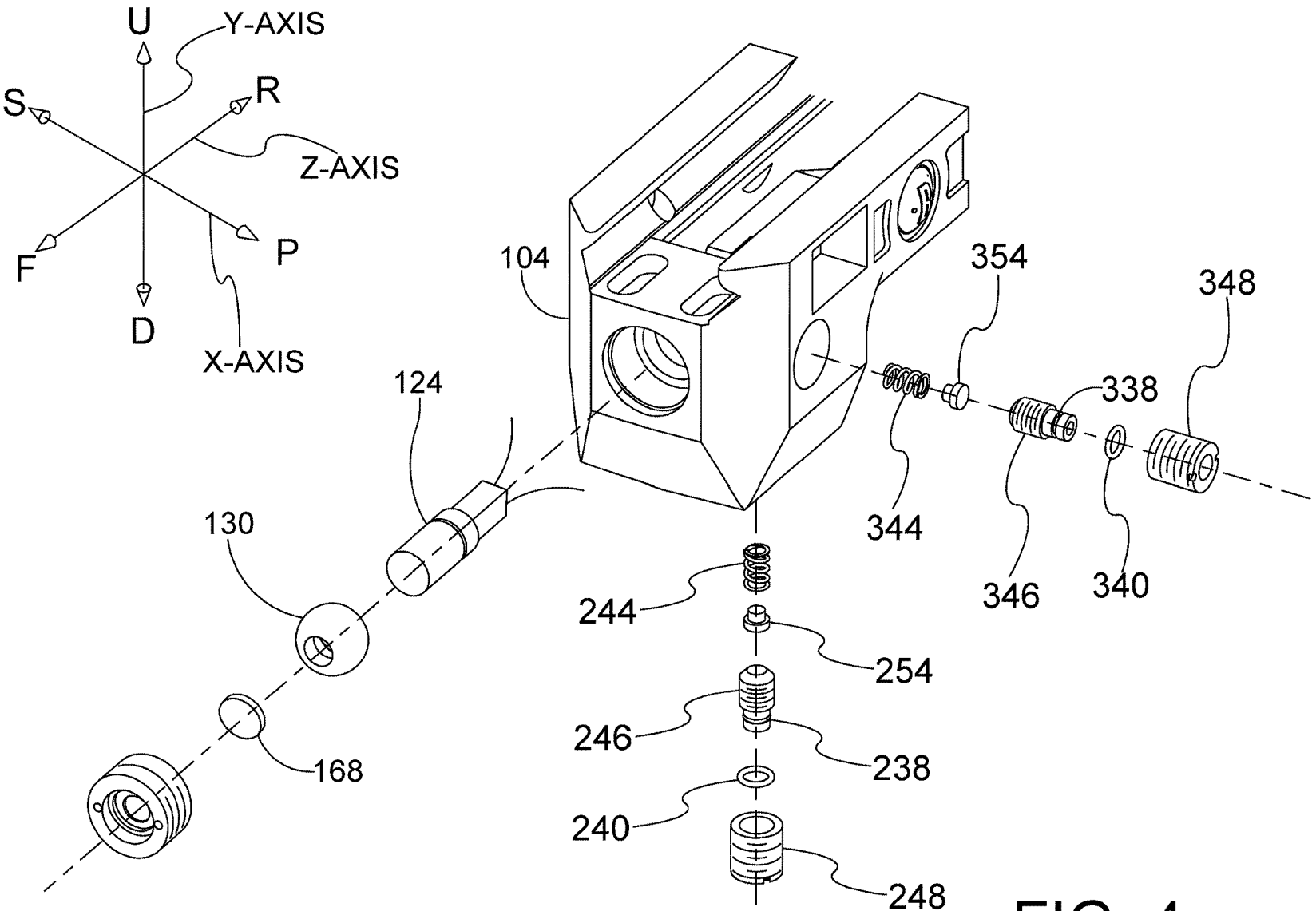
FIG. 4 is a partially exploded view showing a multi-function firearm accessory in accordance with the detailed description.
Figure 5:
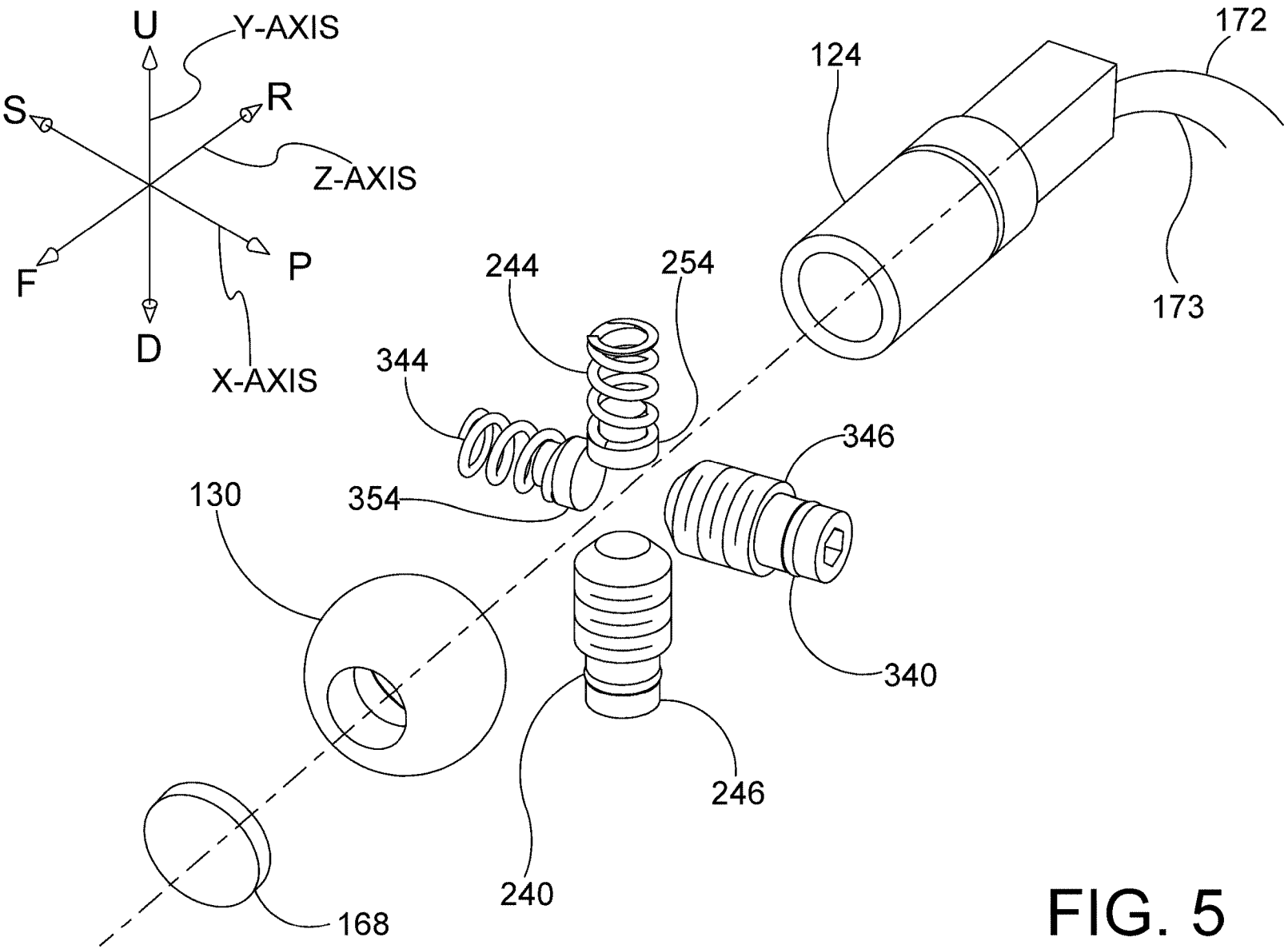
FIG. 5 is an enlarged exploded view further illustrating the multi-function firearm accessory shown in FIG. 4.
Figure 6:
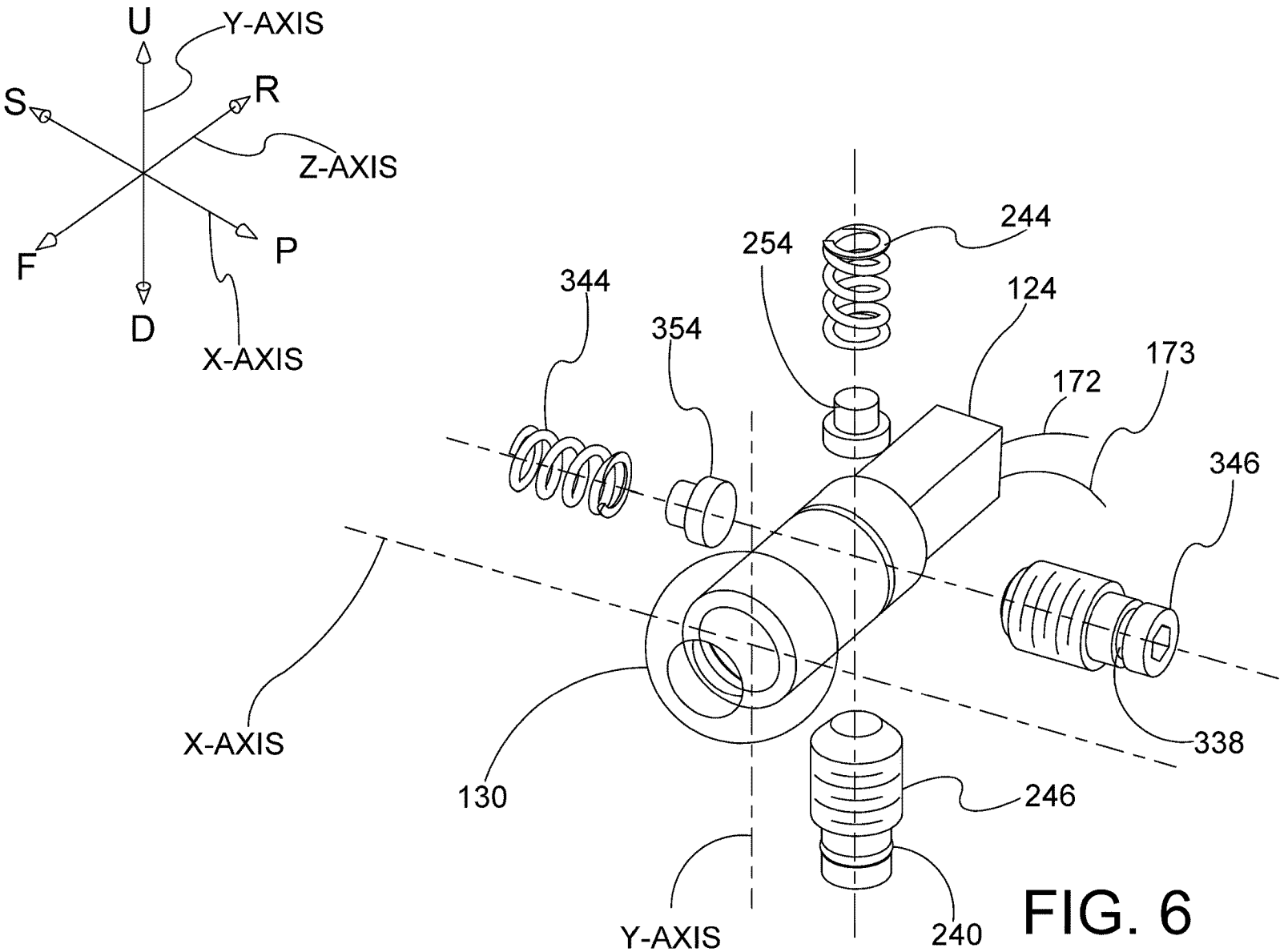
FIG. 6 is an enlarged perspective view further illustrating the multi-function firearm accessory shown in FIG. 4.
Figure 7:
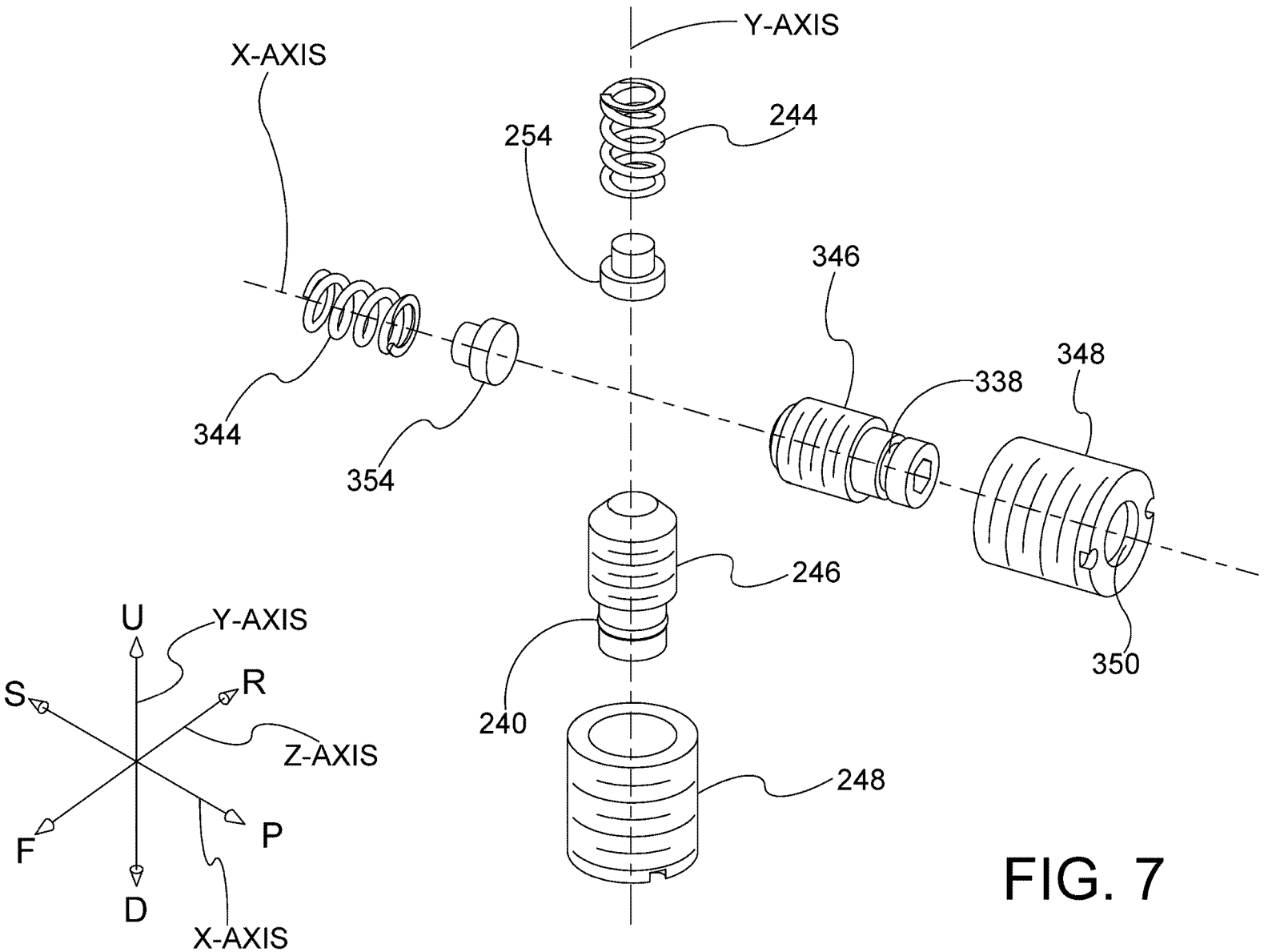
FIG. 7 is an enlarged exploded view further illustrating the multi-function firearm accessory shown in FIG. 4.
Figure 18:
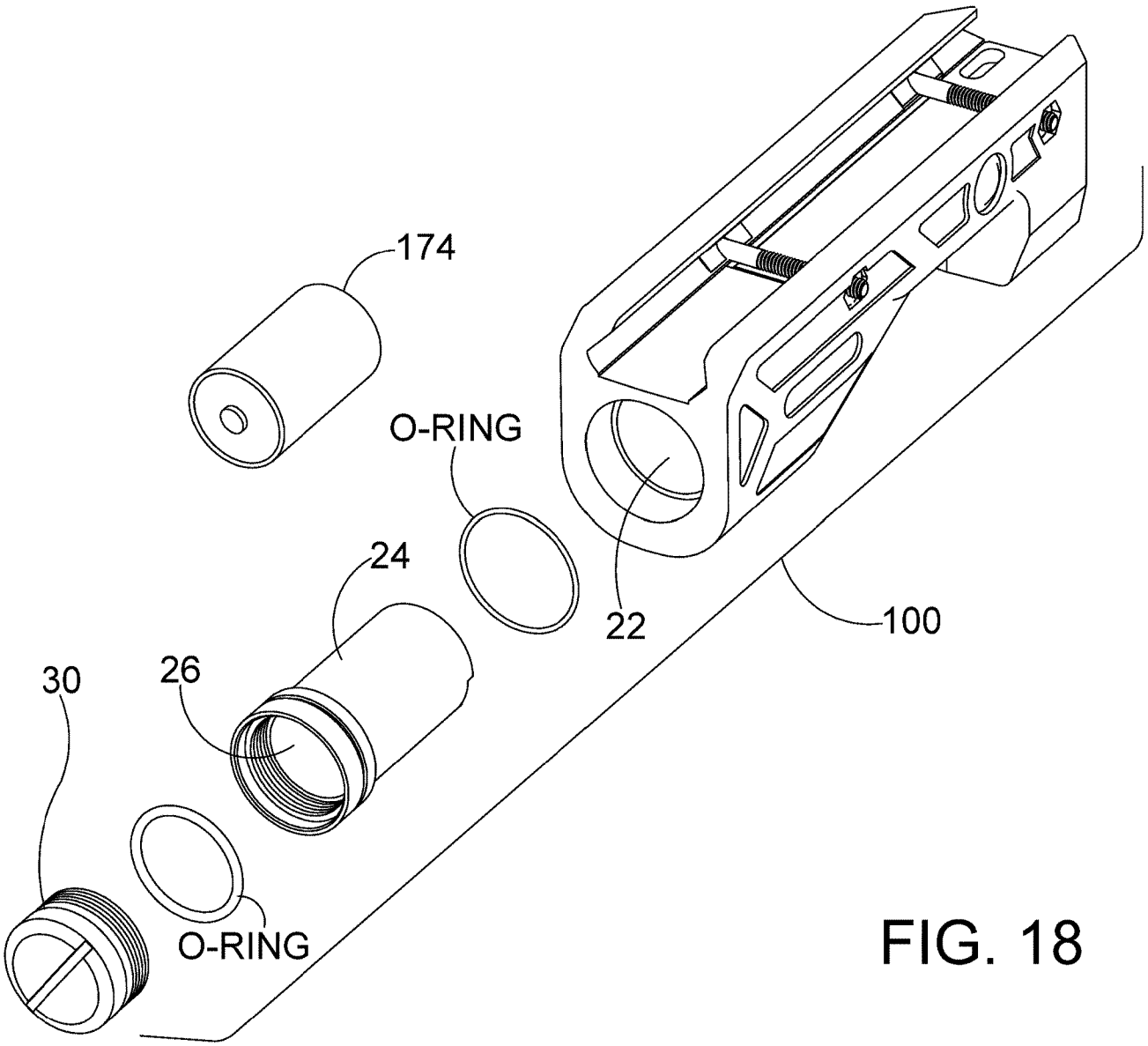
FIG. 18 is an exploded perspective view showing a multi-function firearm accessory in accordance with the detailed description.
Figure 19:
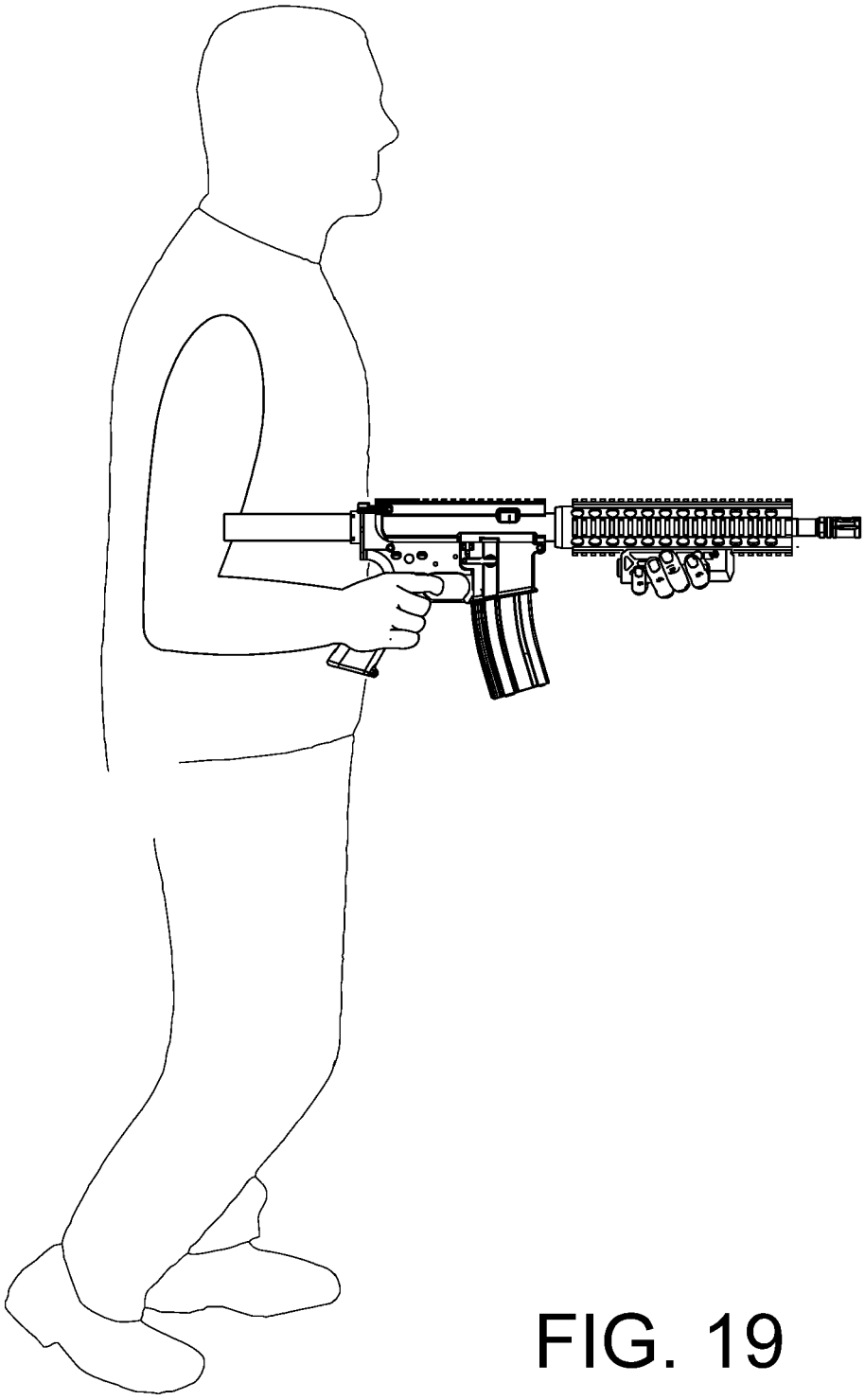
FIG. 19 is a side view showing an AR pistol and a multi-function firearm accessory in accordance with the detailed description.
Figure 20:
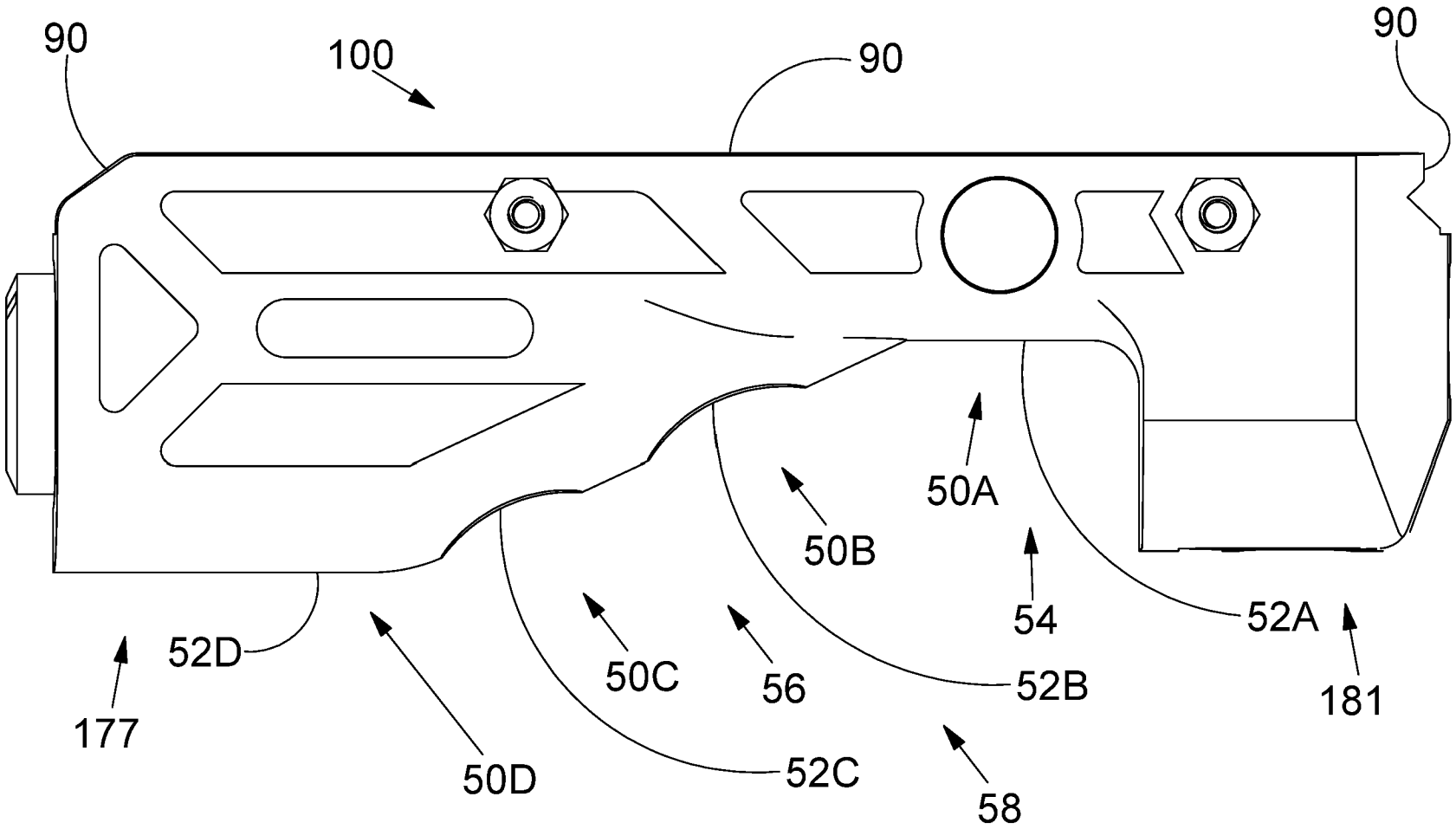
FIG. 20 is a side view showing a multi-function firearm accessory in accordance with the detailed description.

Referring, for example, to FIGS. 3, 4, and 18, a multifunction firearm accessory 100 in accordance with one or more embodiments may comprise a foregrip body 104 comprising a forward post portion, a rearward post portion and an intermediate portion extending between the forward post portion and the rearward post portion. The forward post portion may define a forward cavity 112 and the rearward post portion may define defining a rearward cavity 22. A sleeve 24 may be received in the rearward cavity 22. The sleeve 24 may define a battery cavity 26. The sleeve 24 may including a female thread for receiving a battery cover 30 with a corresponding male thread. The male thread of the battery cover 30 may be disposed in threading engagement with the female thread of the sleeve 24. A battery 174 may be received in the battery cavity 26. A laser housing 124 may be disposed in the forward cavity 112. The forward cavity 112 may open in the forward direction and include a forward opening 110. The laser housing 124 may support a semiconductor chip 126 that emits laser light and a collimating lens 128 that collimates the laser light emitted by the semiconductor chip 126. The flow of electrical power to the semiconductor chip 126 may be controlled by a port switch 352 and a starboard switch 252. The foregrip body 104 may define a notch 180 disposed between the laser housing 124 and the battery 174. The notch 180 may be defined by a rearward vertical surface of the forward post, a horizontal, downward facing surface directly rearward of the rearward facing surface, and a finger engaging surface extending downwardly and rearwardly from the second horizontal surface. The starboard switch 252 may be supported by the foregrip body 104 with the starboard switch 252 being positioned above the notch 180 on a starboard side of the foregrip body 104. The starboard switch 252 may be positioned to receive a tip portion of a left index finger of a left hand while a portion of the left hand is extending through the notch 180 and the foregrip body 104 is disposed between the left index finger and a left thumb of the left hand. The port switch 352 may be positioned above the notch 180 on a port side of the foregrip body 104. The port switch 352 may be positioned to receive a tip portion of a right index finger of a right hand while a portion of the right hand is extending through the notch 180 and the foregrip body 104 is disposed between the right index finger and a right thumb of the right hand.

It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," "portwardly," and "starboardly," should not be interpreted to limit the scope of the invention recited in the attached claims.

Referring to FIGS. 1-8, an upward direction U and a downward direction D are illustrated using arrows labeled "U" and "D." A forward direction F and a rearward direction R are illustrated using arrows labeled "F" and "R," respectively, in FIG. 1. A starboard direction S and a port direction P are illustrated using arrows labeled "S" and "P," respectively, in FIG. 1. In the embodiment of FIG. 1, these directions may be conceptualized from the point of view of a user who is holding a firearm and/or viewing a device affixed to the firearm. The directions illustrated using these arrows are applicable to the apparatus shown and discussed throughout this application. The port direction may also be referred to as the portward direction.

Referring to FIGS. 1-8, a Y-axis generally extends in the upward direction U and the downward or lower direction D and an X-axis generally extends in the starboard direction S and the port direction P. A Z-axis generally extends in the forward direction F and the rearward direction R. In one or more embodiments, the X, Y and Z axes are mutually orthogonal axes.

In one or more embodiments, the upward direction is generally opposite the downward direction. In one or more embodiments, the upward direction and the downward direction are both generally orthogonal to an XZ plane defined by the forward direction and the starboard direction. In one or more embodiments, the forward direction is generally opposite the rearward direction. In one or more embodiments, the forward direction and the rearward direction are both generally orthogonal to a XY plane defined by the upward direction and the starboard direction. In one or more embodiments, the starboard direction is generally opposite the port direction. In one or more embodiments, starboard direction and the port direction are both generally orthogonal to a YZ plane defined by the upward direction and the forward direction. Various direction-indicating terms are used herein as a convenient way to discuss the objects shown in the figures.

The following United States patents are hereby incorporated by reference herein: U.S. Pat. Nos. 8,607,492, 8,683,733, 9,062,933, and 9,182,194. The above references to U.S. patents in all sections of this application are herein incorporated by references in their entirety for all purposes. Components illustrated in such patents may be utilized with embodiments herein. Incorporation by reference is discussed, for example, in MPEP section 2163.07(B).

The above references in all sections of this application are herein incorporated by references in their entirety for all purposes. All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed. The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A laser sight device for use with a firearm, the firearm comprising a receiver, a barrel extending from the receiver, a handguard extending around the barrel, and a lower Picatinny rail attached to the handguard, the laser sight device comprising:

an elongate foregrip body comprising a rail attachment portion for attachment to the Picatinny rail, a forward post portion extending from the rail attachment portion and defining a rearward facing vertical stop surface, an intermediate portion rearward of the forward post portion and defining a first downwardly facing horizontal surface and an inclined surface extending downwardly and rearwardly from the second horizontal surface, and a rearward post portion extending from the rail attachment portion and positioned rearward of the intermediate portion, the rearward post portion defining a second downwardly facing horizontal surface, the foregrip body defining a first cavity and a second cavity;

a laser housing disposed in the first cavity with a laser light generator therein;

a battery disposed in the second cavity;

the foregrip body defining a gripping notch defined by the rearward facing vertical stop surface, the first downwardly facing horizontal surface and the inclined surface extending downwardly and rearwardly from the second horizontal surface, the first horizontal surface extending a length of about one finger width, the inclined surface extending about two finger widths in length, and the second horizontal surface extending at least one finger width in length;

a first switch supported by the foregrip body, the first switch being positioned above the gripping notch on a first side of the foregrip body, the first switch being positioned to be actuated by a hand of a user; and a second switch supported by the foregrip body, the second switch being positioned above the gripping notch on a second side of the foregrip body, the second switch being positioned to be actuated by the hand of the user.

2. The laser sight device of claim 1 wherein the rail attachment portion extends substantially the length of the foregrip body.

3. The laser sight device of claim 2 wherein the rail attachment portion has two tightening segments for securement to the Picatinny rail.

4. The laser sight device of claim 1 further comprising circuitry connecting to the first switch and the second switch, the circuitry and/or the first switch and second switch is configured such that each of the first switch and second switch turns the laser light generator on and off.

5. The laser sight device of claim 1 wherein at least one of the first switch and the second switch comprises a switch substrate overlaying a bottom surface of a second opening, a switch spring overlaying the switch substrate, and a switch cap overlaying the switch spring.

6. The laser sight device of claim 1 in combination with the firearm, the firearm being at least 22 inches in length.

7. The combination of claim 6 wherein the firearm is a gas operated semiautomatic modem sporting rifle.

8. The combination of claim 6 wherein the firearm is a gas operated semiautomatic AR pistol.

9. The laser sight device of claim 1, further comprising:

an elevation adjustment mechanism configured to selectively rotate the laser housing about a horizontal axis; and a windage adjustment mechanism configure to selectively rotate the laser housing about a vertical axis, the vertical axis extending orthogonal to the horizontal axis.

10. A laser sight device for use with a modem sporting rifle, the device comprising:

a foregrip body defining a notch for receiving a hand of a person, the notch extending from a stop surface of the foregrip body to a finger engaging surface of the foregrip body, the foregrip body defining a first opening that opens in a first direction, a second opening that opens in a second direction, and a third opening that opens in a third direction, the second opening and third opening being configured to open in opposite directions;

a laser housing disposed inside the first opening defined by the foregrip body, the laser housing supporting a laser emitting device that emits laser light and a collimating lens that collimates the laser light emitted by the laser emitting device;

a first end of the laser housing being coupled to a spherical bearing, the spherical bearing constraining movement of the laser housing in three translation degrees of freedom corresponding to translation along three mutually orthogonal axes relative to the laser housing, the three mutually orthogonal axes including a vertical axis, a horizontal axis and a longitudinal axis, the spherical bearing allowing rotation of the laser housing about at least the horizontal and vertical axes;

a windage adjustment mechanism comprising a windage adjustment spring and a windage adjustment screw that is threadingly received in a windage adjustment insert, the windage adjustment spring being positioned and configured to bias the laser housing against the windage adjustment screw, and so that rotation of the windage adjustment screw relative to the windage adjustment insert produces rotation of the laser housing about the vertical axis;

an elevation adjustment mechanism comprising an elevation adjustment spring and an elevation adjustment screw that is threadingly received in an elevation adjustment insert, the elevation adjustment spring being positioned and configured to bias the laser housing against the elevation adjustment screw, and so that rotation of the elevation adjustment screw relative to the elevation adjustment insert produces rotation of the laser housing about the horizontal axis;

a first switch disposed in the second opening defined by the foregrip body; and a second switch disposed in the third opening defined by the foregrip body.

11. The laser sight device of claim 10, wherein the spherical bearing comprises a spherical surface that is received in a cup.

12. The laser sight device of claim 10, wherein the windage adjustment insert includes a windage adjustment shoulder positioned and configured to limit travel of the windage adjustment screw.

13. The laser sight device of claim 10, wherein the elevation adjustment insert includes an elevation adjustment shoulder positioned and configured to limit travel of the elevation adjustment screw.

14. The laser sight device of claim 10, wherein each of the first and second switch comprises a switch substrate overlaying a bottom surface of its respective opening, a switch spring overlaying the switch substrate, and a switch cap overlaying the switch spring.

15. The laser sight device of claim 14, wherein the first and second switch substrates each comprise first and second conductors disposed on a facing surface thereof, each switch spring being deformable between an unstressed configuration in which an inner surface of the switch spring is concave and a deformed configuration in which the switch spring completes an electrical circuit between the first conductor and the second conductor of the switch substrate, each switch spring being positioned and configured to assume the deformed configuration when a directed depressing force is applied to the switch cap.

16. The laser sight device of claim 10, wherein the finger engaging surface is sloped so that the finger engaging surface extends downward as the finger engaging surface extends rearward from a laser emitting front of the laser sight device.

17. A laser sight device in combination with a modem sporting rifle, the mode sporting rifle comprising:

a receiver;

a barrel extending from the receiver;

a handguard surrounding the barrel; and a lower rail attached to the handguard;

the laser sight device comprising an elongate foregrip body comprising a rail attachment portion for attachment to the rail, a first post portion extending from the rail attachment portion, the foregrip body defining a first cavity and having a first surface defining an exterior rearward facing vertical stop surface on the first post portion;

an intermediate recessed portion extending from the rail attachment portion and positioned substantially adjacent to the first post portion and defining a first downwardly facing horizontal surface; and a second post portion extending from the rail attachment portion and positioned substantially adjacent to the intermediate portion, the rearward post portion defining a second downwardly facing horizontal surface, the second post portion defining a second cavity;

a laser housing disposed in the first cavity with a laser light generator therein;

a battery disposed in the second cavity;

the foregrip body defining a gripping notch disposed between the laser housing and the battery, the gripping notch defined by at least the rearward facing vertical stop surface of the first post portion, the first downwardly facing horizontal surface and an inclined surface extending downwardly and rearwardly from the second horizontal surface, the first horizontal surface extending a length of about one finger width, the inclined surface extending about two finger widths in length, the second horizontal surface extending at least one finger width in length;

a first switch supported by the foregrip body, the first switch being positioned above the notch on a first side of the foregrip body, the first switch being positioned to receive a portion of a finger of the user of the laser sight device; and a second switch supported by the foregrip body, the second switch being positioned above the notch on a second side of the foregrip body, the second switch being positioned to receive another portion of another finger of the user of the laser sight device.

18. The laser sight device in combination with a modem sporting rifle of claim 17 wherein the modem sporting rifle does not have a rear stock.

19. The laser sight device in combination with a modem sporting rifle of claim 17 wherein the laser sight device further comprises circuitry connecting to the first switch and the second switch, the circuitry and/or the first switch and second switch is configured such that each of the first switch and second switch turns the laser light generator on and off.

20. The laser sight device in combination with a modem sporting rifle of claim 17 wherein the laser sight device further comprises an elevation adjustment mechanism configured to selectively rotate the laser housing about a first axis; and a windage adjustment mechanism configure to selectively rotate the laser housing about a second axis, the second axis extending orthogonal to the first axis.

21. A laser sight device for use with a firearm, the firearm comprising a receiver, a barrel extending from the receiver, a handguard extending around the barrel, and a lower rail attached to the handguard, the laser sight device comprising:

an elongate foregrip body comprising a rail attachment portion for attachment to the rail, a forward post portion extending from the rail attachment portion and defining a rearward facing vertical stop surface, an intermediate portion rearward of the forward post portion and defining a first downwardly facing horizontal surface and an inclined surface extending downwardly and rearwardly from the second horizontal surface, and a rearward post portion extending from the rail attachment portion and positioned rearward of the intermediate portion, the rearward post portion defining a second downwardly facing horizontal surface, the foregrip body defining a first cavity and a second cavity;

a laser housing disposed in the first cavity with a laser light generator therein;

a battery disposed in the second cavity;

the foregrip body defining a gripping notch defined by the rearward facing vertical stop surface, the first downwardly facing horizontal surface and the inclined surface extending downwardly and rearwardly from the second horizontal surface, the first horizontal surface extending a length of about one finger width, the inclined surface extending about two finger widths in length, and the second horizontal surface extending at least one finger width in length;

a first switch supported by the foregrip body, the first switch being positioned above the gripping notch on a first side of the foregrip body, the first switch being positioned to be actuated by a hand of a user; and a second switch supported by the foregrip body, the second switch being positioned above the gripping notch on a second side of the foregrip body, the second switch being positioned to be actuated by the hand of the user.

* * * * *